US010677061B2

(12) United States Patent
Lockhart et al.

(10) Patent No.: US 10,677,061 B2
(45) Date of Patent: Jun. 9, 2020

(54) SHEAR FLOW TURBOMACHINERY DEVICES

(71) Applicant: Douglas Lloyd Lockhart, Cobble Hill (CA)

(72) Inventors: Douglas Lloyd Lockhart, Cobble Hill (CA); Peter Colin Harwood, North Lambton (AU)

(73) Assignee: Douglas Lloyd Lockhart, Cobble Hill (CA)

( * ) Notice: Subject to any disclaimer, the term of this patent is extended or adjusted under 35 U.S.C. 154(b) by 143 days.

(21) Appl. No.: 15/758,298

(22) PCT Filed: Sep. 9, 2016

(86) PCT No.: PCT/CA2016/051070

§ 371 (c)(1),
(2) Date: Mar. 7, 2018

(87) PCT Pub. No.: WO2017/041182

PCT Pub. Date: Mar. 16, 2017

(65) Prior Publication Data

US 2018/0266250 A1 Sep. 20, 2018

Related U.S. Application Data

(60) Provisional application No. 62/216,940, filed on Sep. 10, 2015.

(51) Int. Cl.
*F01D 1/36* (2006.01)
*F04D 1/06* (2006.01)
(Continued)

(52) U.S. Cl.
CPC ..... *F01D 1/36* (2013.01); *F04D 1/06* (2013.01); *F04D 5/001* (2013.01); *F04D 17/161* (2013.01); *F04D 29/447* (2013.01)

(58) Field of Classification Search
CPC ..... F01D 1/36; F04D 5/001; F04D 29/447; F04D 1/06; F04D 17/161
See application file for complete search history.

(56) References Cited

U.S. PATENT DOCUMENTS 2,610,786 A 9/1952 Howard
3,249,293 A 5/1966 Koff
(Continued)

FOREIGN PATENT DOCUMENTS

CA 2886985 A1 4/2014
GB 1063096 A 3/1967

OTHER PUBLICATIONS

European Patent Application No. 16843337.3, Extended European Search Report dated Mar. 22, 2019.
(Continued)

*Primary Examiner* — Eldon T Brockman
(74) *Attorney, Agent, or Firm* — Borden Ladner Gervais LLP; Geoffrey deKleine

(57) ABSTRACT

A shear flow turbomachinery device includes a housing having housing walls defining a cavity, a shaft extending into the cavity though a shaft opening in the housing wall at an end of the cavity, a rotor coupled to the shaft within the cavity, the rotor having a plurality of disks extending radially outward from a central axis of the rotor, the disks having a spaced arrangement forming a gap between adjacent disks, and a shroud for shrouding the rotor, the shroud including a pair of end disks coupled to opposing ends of the rotor, a screen extending between outer edges of the pair of end disks, the screen extending around the rotor between the rotor and the housing walls, wherein the shroud is freely rotatable independent of rotation of the rotor to reduce drag on the disks due to the housing walls when the cavity if filled with fluid and the shaft and plurality of disks are rotated.

19 Claims, 16 Drawing Sheets

(51) Int. Cl.

| | |
|---|---|
| ***F04D 5/00*** | (2006.01) |
| ***F04D 29/44*** | (2006.01) |
| ***F04D 17/16*** | (2006.01) |

(56) References Cited

U.S. PATENT DOCUMENTS

| | | | | |
|---|---|---|---|---|
| 4,084,924 | A | 4/1978 | Ivanoff et al. | |
| 5,191,247 | A * | 3/1993 | Possell | F04D 17/161 310/51 |
| 6,227,796 | B1 * | 5/2001 | Markovitch | F04D 5/001 415/199.1 |
| 2004/0035093 | A1 | 2/2004 | Conrad et al. | |
| 2014/0321976 | A1 | 10/2014 | Kerns et al. | |
| 2016/0146101 | A1 | 5/2016 | Lee | |

OTHER PUBLICATIONS

International Patent Application No. PCT/CA2016/051070, International Preliminary Report on Patentability dated Mar. 22, 2018.
International Patent Application No. PCT/CA2016/051070, International Search Report and Written Opinion dated Nov. 10, 2016.
Chinese Patent Application No. CN201680064476.9, Office Action dated Jul. 1, 2019—English Translation not Available.

* cited by examiner

SHEAR FLOW TURBOMACHINERY DEVICES

TECHNICAL FIELD

The present disclosure relates to shear flow turbomachinery devices, including shear flow turbines and shear flow pumps.

BACKGROUND

Shear flow turbomachinery devices, or simply shear flow devices, include a housing having a chamber that encloses a rotor. The rotor is coupled to a shaft and includes a plurality of spaced apart disks that rotate together with the rotation of the shaft. The chamber of the housing has internal dimensions that closely match the dimensions of the rotor. Shear flow devices include shear flow turbines and shear flow pumps.

In shear flow turbines, a nozzle directs a fluid jet toward the disks in a direction tangential to the disks' edges and perpendicular to the shaft. The fluid jet causes the disks to rotate, converting fluid pressure and flow into rotational mechanical energy.

In shear flow pumps, the shaft is rotated such that the rotating disks of the rotor apply a shear force to fluid within the chamber. The shear force generates a circular flow of fluid that moves outwardly from the shaft due to the centrifugal force. In this manner, a shear flow pump converts rotational mechanical energy into fluid pressure and flow.

Limited commercial use of shear flow devices has been made due, at least in part, to reduced efficiencies compared to other types of turbines and pumps.

Improvements to shear flow turbomachinery devices are desired.

SUMMARY

One aspect of the invention provides a shear flow turbomachinery device that includes a housing having housing walls defining a cavity, a shaft extending into the cavity though a shaft opening in the housing wall at an end of the cavity, a rotor coupled to the shaft within the cavity, the rotor having a plurality of disks extending radially outward from a central axis of the rotor, the disks having a spaced arrangement forming a gap between adjacent disks, and a shroud for shrouding the rotor, the shroud including a pair of end disks coupled to opposing ends of the rotor, a screen extending between outer edges of the pair of end disks, the screen extending around the rotor between the rotor and the housing walls, wherein the shroud is freely rotatable independent of rotation of the rotor to reduce drag on the disks due to the housing walls when the cavity if filled with fluid and the shaft and plurality of disks are rotated.

Another aspect of the invention provides A shear flow turbomachinery device including a first shear flow stage including a first housing having first housing walls defining a first conical-shaped cavity, a first shaft having a first end that extends into the first cavity through a first shaft opening in the first housing wall at a first end of the first cavity, and a first conical-shaped rotor coupled to the first end of the first shaft, the first conical shaped rotor including a plurality of disks extending radially outward from a central axis of the first rotor, the disks having a spaced arrangement to form a gap between adjacent disks, wherein the disks are arranged such that diameters of the disks increase with increased distance from a first end of rotor such that the rotor has a conical shape that generally matches the conical shape of the first conical-shaped cavity.

DRAWINGS

The following figures set forth embodiments in which like reference numerals denote like parts. Embodiments are illustrated by way of example and not by way of limitation in the accompanying figures.

FIG. 10B is an end view of various protrusions for the disk according to the embodiment shown in FIG. 10A;

DETAILED DESCRIPTION

Figure 1A:
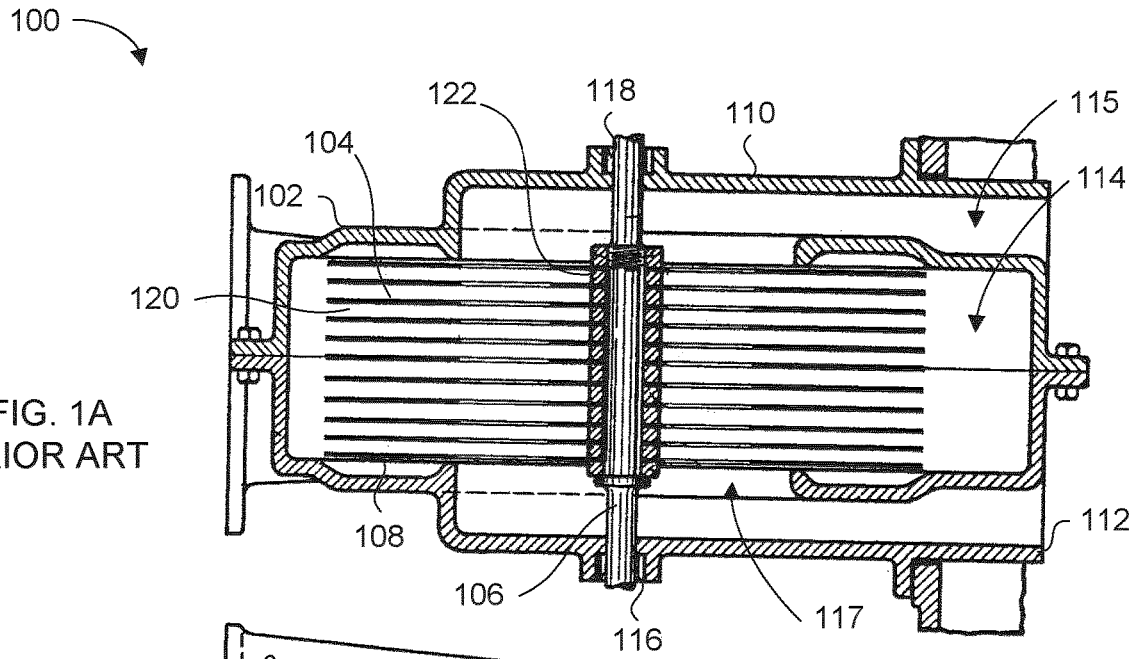
FIG. 1A PRIOR ART
FIG. 1A is a sectional bottom view of a shear flow pump according to the prior art.

The following describes shear flow turbomachinery devices including shear flow turbines and shear flow pumps and shear flow compressors. Although some shear flow devices may be referred to as shear flow pumps, it is understood that a shear flow pump may be utilized as either a pump or a compressor. For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 1B:
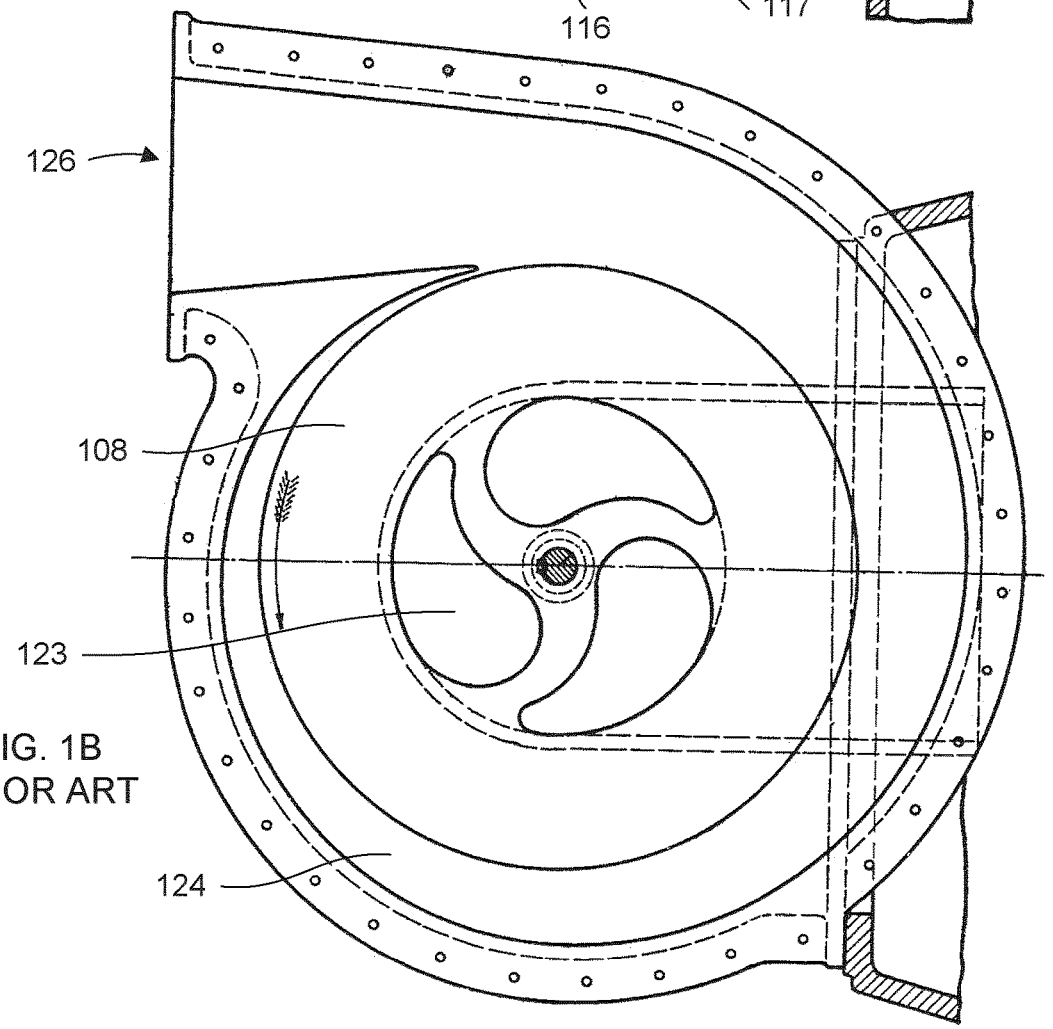
FIG. 1B PRIOR ART
FIG. 1B is a sectional side view of the prior art shear flow pump shown in FIG. 1A.

FIGS. 1A and 1B show an example of a shear flow pump 100 according to the prior art. The shear flow pump 100 includes a housing 102, a rotor 104, and a shaft 106.

The housing 102 includes a front housing wall 110 and a back housing wall 112 that define an inner cavity 114 and an outer cavity 115. The rotor 104 is located within the inner cavity 114. The rotor 104 includes a plurality of disks 108 that extend radially from the shaft 106.

The shaft 106 passes through the housing 110 through openings 116, 118 in the housing walls 110, 112. The shaft 106 may be connected to a motor or generator (not shown) external to the housing 102. The shaft 106 may be connected to the motor or generator either directly or via gears or belts, or the like.

The disks 108 are spaced apart on the shaft 106 to form a gap 120 between adjacent disks 108 for fluid to pass through. The spacing between adjacent disks 108 is provided by spacers 122. The spacers 122 in the pump 100 are round washers placed on the shaft 106 between the disks 108, however other types of spacers 122 may be utilized. The disks 108 include apertures 123 that provide a passage for fluid entering through the axial inlet 117 to flow within the gaps 120 between the disks 108.

Although the disks 108 of the shear flow pump 100 shown in FIG. 1 are flat, alternative shear flow pumps have been proposed that include multiple cones rather than disks. Prior art cones consist of the standard disks extending outward from the shaft at an angle, rather than extending perpendicularly as shown in FIG. 1A, forming a series of cones all having the same outer diameter.

The housing 102 is shaped to form a volute that is utilized for a collector 124 and a diffuser outlet 126. The collector 124 collects the fluid tangentially from the disks 108, which exits via the diffuser outlet 126.

In other examples of pumps, a rectangular cross sectional outlet may be included. The rectangular cross sectional outlet may also be utilized as an inlet in order to facilitate dual purpose utilization of shear flow device as a turbine and pump, with the fluid flow direction when utilized as a turbine reversed relative to the flow direction when the device is utilized as a pump.

The outlet 126 may be coupled to a flow rate regulator (not shown) to regulate the pressure within the inner cavity 114 of the pump 100 in order to increase the efficiency of the pump 100 by controlling the torque and flow rate conditions between the disks 108.

In operation, the shaft 106 is rotated by an externally applied torque from, for example, a motor or turbine (not shown). The rotation of the shaft 106 causes rotation of the disks 108. A fluid enters the pump 100 through the outer cavity 115 and into the inner cavity 114 via the axial inlet 117. The fluid flows through the apertures 123 in the disks 108 and into the gaps 120.

The rotating disks 108 apply a force to the fluid within the gaps 120 due to viscous shear, drawing the fluid in a circular motion. The momentum of the fluid and the circular motion causes the fluid to flow outward toward the outer edge of the disks 108 in a spiral path. At the outer edge of the disks 108, the fluid exits the gaps 120 and flows into a collector 124 defined by the inner cavity 114 in a direction tangential to the edge of the disks 108. The speed of the fluid leaving the gaps 120 may be nearly equal to the speed of outer edge of the disks 108. In the collector 124, the speed of the fluid flow slows and the fluid's static pressure increases. The fluid exits from the pump via the outlet 126.

Figure 2A:
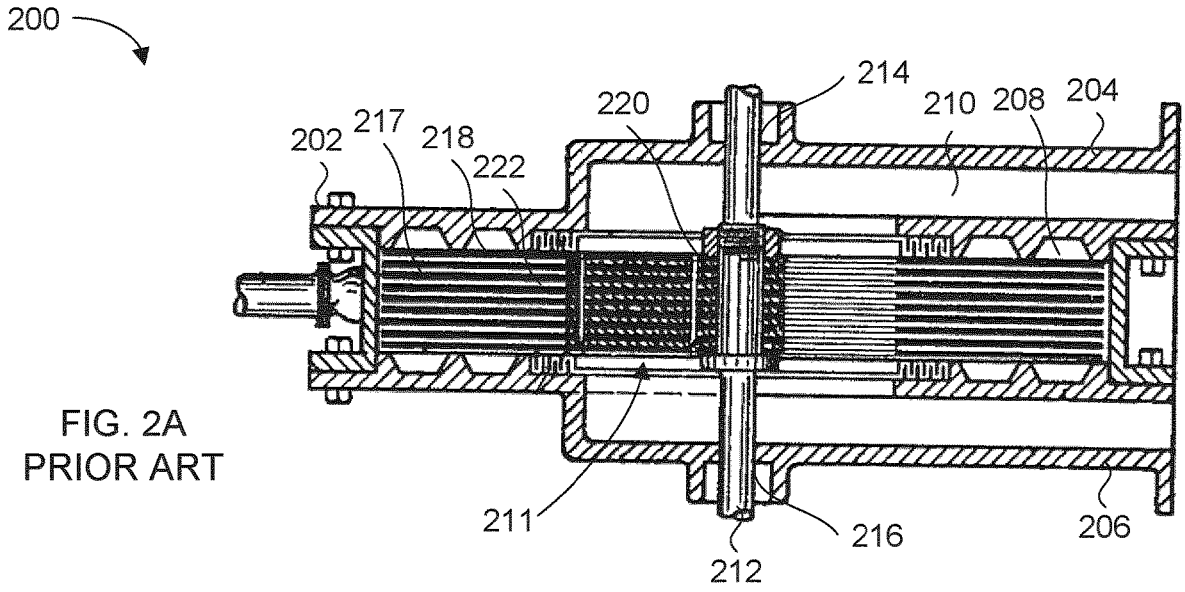
FIG. 2A PRIOR ART
FIG. 2A is a sectional bottom view of a shear flow turbine according to the prior art.
Figure 2B:
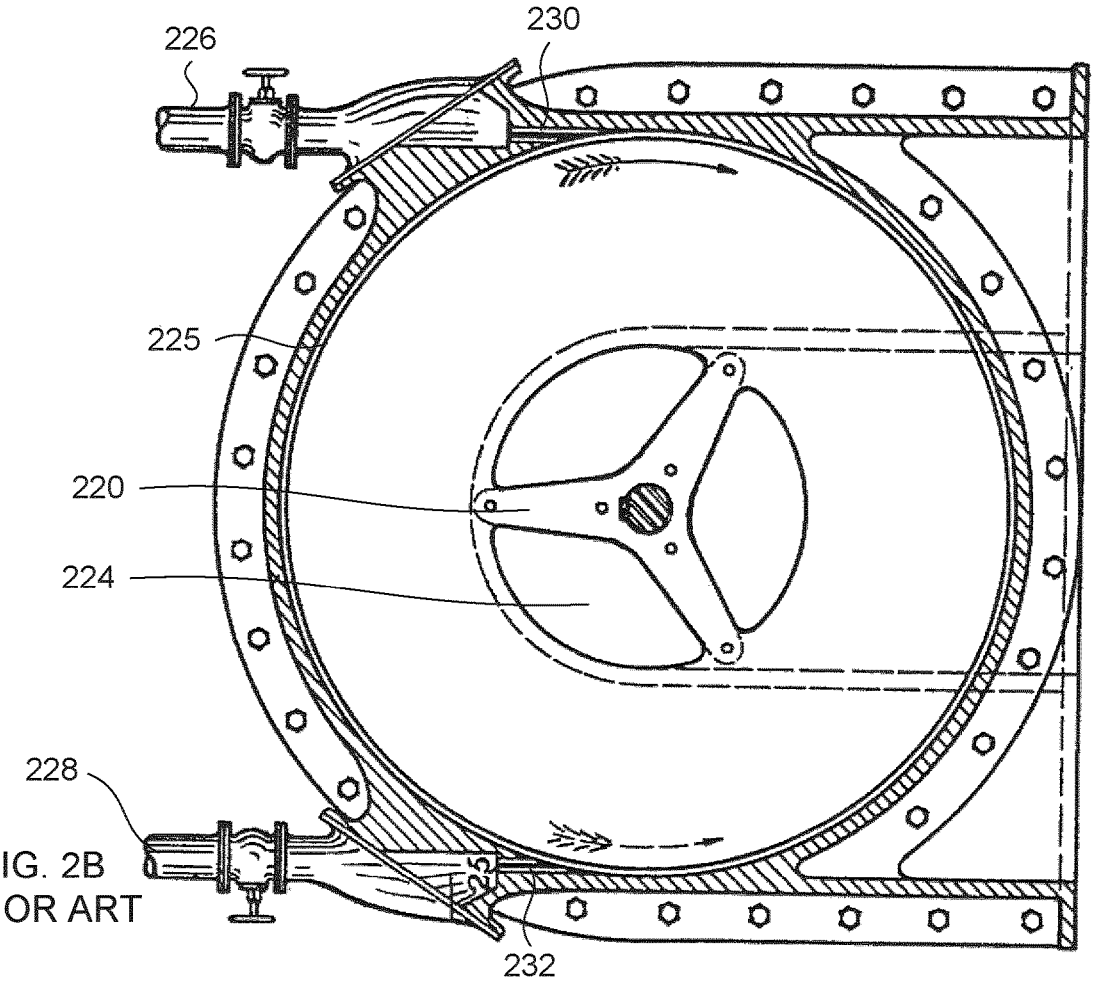
FIG. 2B PRIOR ART
FIG. 2B is a sectional side view of the prior art shear flow turbine shown in FIG. 2A.

Referring now to FIGS. 2A and 2B, a shear flow turbine 200 according to the prior art is shown. The shear flow turbine 200 includes a housing 202 having front wall 204 and a back wall 206 that define an inner cavity 208 and an outer cavity 210. An outlet 211 facilitates fluid flow between the inner cavity 208 and the outer cavity 210. A shaft 212 passes through opening 214 in the front wall 204 and opening 216 in the back wall 206.

A rotor 217 is located within the inner cavity 208. The rotor 217 includes plurality of disks 218 that extend radially from the shaft 212 within the inner cavity 208. The disks 218 are approximately equal in diameter. Spacers 220 between adjacent disks 218 space the disks 218 apart on the shaft 212, forming gaps 222 into which fluid may flow. The spacers 220 shown in FIG. 2B are "Y" shaped spacers. The disks 218 include apertures 224 that provide a passage for fluid to flow between the gaps 222 and the outer cavity 210.

The turbine 200 includes a first nozzle 226 and a second nozzle 228 for directing a fluid jet tangentially onto the outer edge 225 of the disks 218 in a direction perpendicular to the longitudinal axis of the shaft 212. The first nozzle 226 is utilized to cause rotation of the disks 218 and shaft 212 in a clockwise direction, as viewed in FIG. 2B. The second nozzle 228 is utilized to cause rotation of the disks 218 and the shaft 212 in a counter-clockwise direction, as viewed in FIG. 2B.

The nozzles 226, 228 shown in FIGS. 2A and 2B are wedge shaped nozzles with a rectangular cross section. The wedge shape nozzles 226, 228 have a reduced cross sectional area toward the nozzle outlets 230, 232 such that the speed of the fluid jet increases as the fluid is forced through the nozzles 226, 228, resulting in a high speed fluid jet exiting through nozzle outlets 230, 232.

In operation, a high pressure fluid enters the turbine 200 through, for example, the first nozzle 226. The fluid accelerates as it passes through the nozzle 226, exiting the nozzle outlet 230 as a high speed fluid jet directed tangentially at the edges 225 of the disks 218. The fluid jet impinges upon the edges 225 of the disks 218 and passes into the gaps 222, dragging the disks 218 by viscous shear and imparting the fluid's momentum to the disks 218, causing the disks 218 to rotate. The rotation of the disks 218 produces a torque on the shaft 212, transforming the pressure and kinetic energy of the fluid into rotational mechanical energy in the shaft 212. The fluid travels through the gaps 222 in a spiral path toward shaft 212. The fluid flows through the apertures 224 and into the outer cavity 210 via the outlet 211 where the fluid exits the turbine 200.

During operation, the torque applied to the shaft 212 by an electric generator or compressor may be modified to regulate the flow rate of the turbine 200 and to improve the efficiency of the turbine 200. Alternatively, or additionally, flow rate may be regulated by controlling the flow into the nozzles, or controlling the flow rate out of the turbine, or both.

In shear flow devices, such as pump 100 and shear flow turbine 200, the size of the gaps between the disks may be adjusted to increase the efficiency of the shear flow device. With the exception of some very high viscosity fluids, typically gaps between disks may be on the order of 1 mm or less for most fluids and flows. In applications utilized for low viscosity, high density fluids, the gap between disks may be less than 100 microns.

Figure 3:
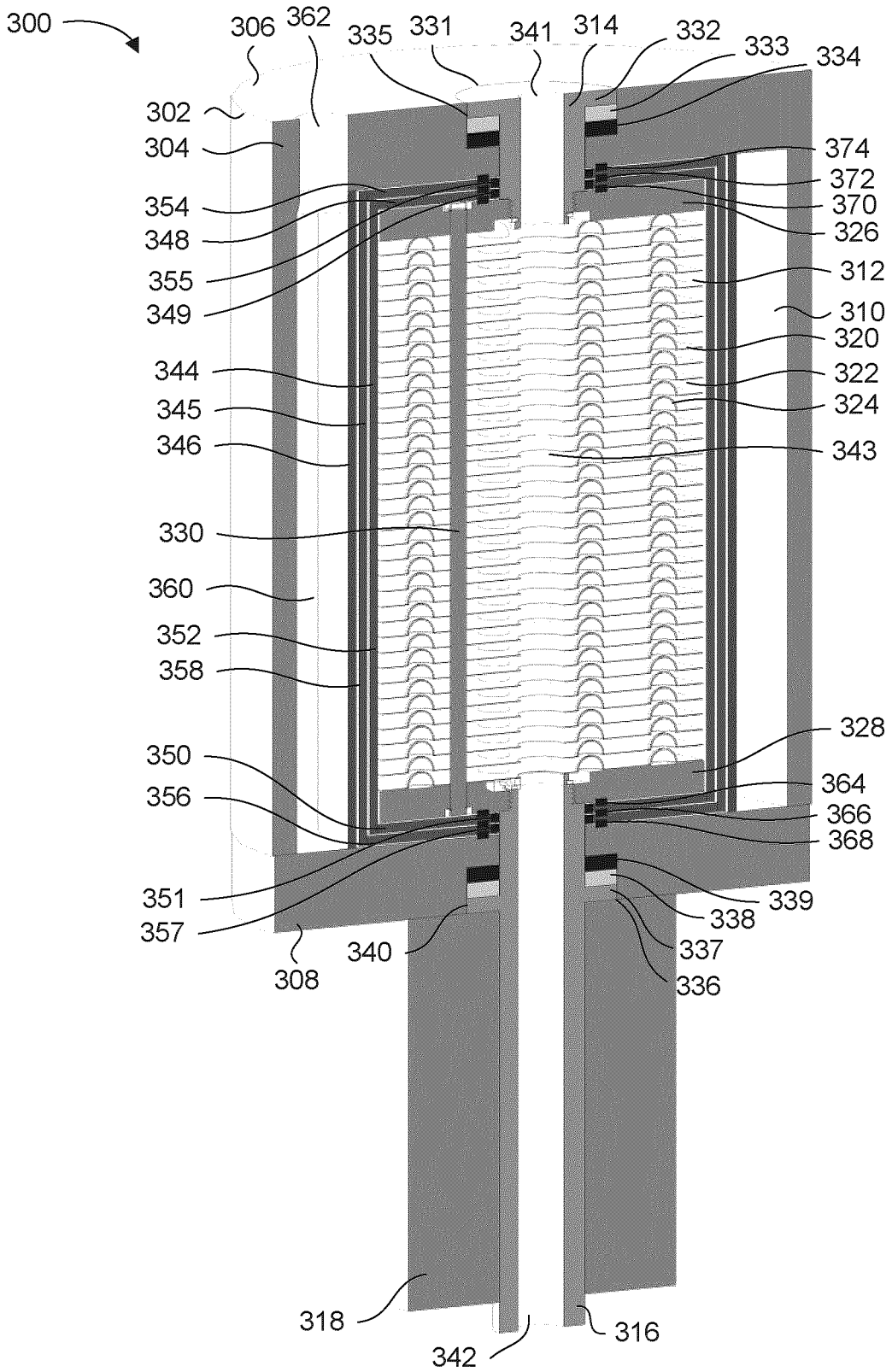
FIG. 3 is a cutaway perspective view of a shear flow pump according to an embodiment.

Referring now to FIG. 3, an embodiment of a shear flow pump 300 according to the present disclosure is shown. As described in more detail below, the shear flow pump 300 includes free-spinning porous shrouds arranged around the rotor. The free-spinning porous shrouds increase the efficiency of the pump 300 compared to prior art shear flow pumps by reducing the energy lost through housing drag.

The pump 300 includes a housing 302 that is generally cylindrically shaped. The housing 302 includes a sidewall 304 extending between an upper wall 306 and a lower wall 308. The sidewall 304, the upper wall 306, and the lower wall 308 define a generally cylindrical rotor chamber 310 that encloses a rotor 312. The terms "upper" and "lower" as used herein reference the orientation of the pump 300 shown in FIG. 3 and are not intended to be otherwise limiting. The rotor 312 is coupled to an upper shaft portion 314 and a lower shaft portion 316. A motor 318 encloses the lower shaft portion 316 for rotating the lower shaft portion 316, which rotates the rotor 312.

The rotor 312 includes a plurality of disks 320 that are spaced apart to form gaps 322 between adjacent disks 320. The disks 320 include optional protrusions 324 extending from the disk 320 into the gaps 322. The protrusions 324 increase the surface roughness of the disks 320. Increasing surface roughness increases the drag between a fluid within the gaps 322 and the disks 320, increasing the momentum transfer from the disks 320 to the fluid. Increased roughness also increases the laminar boundary layer thickness of the fluid flowing over the disks 320. Increased laminar boundary layer thickness due to the protrusions 324 facilitates utilizing fewer disks 320 with larger gaps 322 compared with a rotor utilizing disks with smooth surfaces to apply a given torque to a fluid. The protrusions 324 may also facilitate a more uniform size of the gap 322 radially across the surface of the disks 320 by forming a bridge between disks inhibiting the disks 320 from moving closer together or warping.

The rotor 312 includes an upper end disk 326 and a lower end disk 328. The upper end disk 326 and lower end disk 328 are thicker than the disks 320 of the rotor 312 to provide increased rigidity in the rotor 312. The disks 320 are coupled to the upper end disk 326 and the lower end disk 328 by throughbolts 330. The upper end disk 326 is coupled to the upper shaft portion 314. The lower end disk 328 is coupled the lower shaft portion 316. The upper end disk 326 may be coupled to the upper shaft portion 314 and the lower end disk 328 may be coupled to the lower shaft portion 316 by, for example, threaded connections or by circlips.

Alternatively, the upper shaft portion 314 and the upper end disk 326 may be formed in a single piece. The upper shaft portion 314 and the upper end disk 326 may be formed in a single piece by, for example, 3D printing, or any other suitable method. Similarly, the lower shaft portion 316 and the lower end disk 328 may be formed of a single piece and may be formed by, for example, 3D printing or any other suitable method.

The upper shaft portion 314 extends through an upper shaft opening 331 in the upper wall 306 of the housing 302. The upper shaft portion 314 includes a lip 332 that pushes against an upper seal 333 to inhibit fluid leaking through the upper wall 306. An upper shaft bearing 334 is located between the upper seal 333 and the upper wall 306 of the housing 302. The lip 332, upper seal 333, and upper shaft bearing 334 are received within an upper notch 335 in the upper wall 306 of the housing 302.

Similarly, the lower shaft portion 316 extends through a lower shaft opening 336 in the lower wall 308 of the housing 302. The lower shaft portion 316 includes a lip 337 that pushes against a lower seal 338 to inhibit fluid leaking through the lower wall 308 around the lower shaft portion 316. A lower shaft bearing 339 is located between the lower seal 338 and the lower wall 308 of the housing 302. The lip 337, the lower seal 338, and the lower shaft bearing 339 are received in a lower notch 340 in the lower wall 308 of the housing 302.

The upper bearing 334 and lower bearing 339 may be, for example, electrodynamic homopolar levitating bearings or aerodynamic bearings that cause the upper and lower shaft portions 314 and 316 to "float" relative to the housing 302, reducing frictional drag on the upper and lower shaft portions 314 and 316 during rotation. Electrodynamic homopolar levitating bearings or aerodynamic bearings may not fully support the weight of the upper and lower shaft portions 314 and 316 and the rotor 312. In the case example in which the bearings 334 and 339 electrodynamic homopolar levitating bearings or aerodynamic bearings, the bearings 334, 339 are radial only bearings, with the majority of the weight of the upper and lower shaft portions 314 and 316 and the rotor 312 supported by other bearings, as described further below.

The upper shaft portion 314 is hollow and includes an upper inlet 341. Similarly, the lower shaft portion 316 is hollow and includes a lower inlet 342. Each of the disks 320 includes a central opening 343 that are aligned with the hollow upper and lower shaft portions 314, 316 such that fluid that enters through the upper inlet 341 and the lower inlet 342 may flow through the rotor 312 and into the gaps 322 between the disks 320.

Providing upper and lower inlets 341 and 342 increases the inlet cross sectional area compared to a single inlet, facilitating a reduced flow rate of a fluid through the upper and lower shaft portions 314 and 316 and the rotor 312. Further, providing an upper inlet 341 and a lower inlet 342 shortens the distance that a fluid entering through one of the inlets 341 and 342 flows through. A reduced flow and shortened flow distance may reduce efficiency losses due to the fluid travelling through the shafts 314 and 316 and the rotor 312. Alternatively, one of the upper shaft portion 314 and the lower shaft portion 316 may be solid such that the shear flow pump 300 includes a single inlet.

In some cases, the motor 318 may include additional structure to provide cooling to the motor 318 such as, for example, when the motor 318 is within a refrigerant stream. The cooling structure may include, for example, channels in and around the windings of an electrical motor 318 for a cooling fluid to flow in order to cool the windings.

The rotor 312, including the disks 320, and upper and lower end disks 326 and 328 rotate within a free-spinning inner shroud 344, a free-spinning outer shroud 345, and a fixed porous membrane 346. "Free spinning" as used herein means that the inner and outer shrouds 344 and 345 spin independent of the rotor 312 and upper and lower shaft portions 314 and 316.

The inner shroud 344 includes an upper inner end disk 348, a lower inner end disk 350, and a porous inner membrane 352. The porous inner membrane 352 extends between the outer edges of the upper and lower inner end disks 348 and 350. The upper inner end disk 348 is positioned between the upper end disk 326 of the rotor 312 and the upper wall 306 of the housing 302. The upper inner end disk 348 is annularly shaped to fit around the upper shaft portion 314. An optional upper inner radial bearing 349 is located between the upper inner end disk 348 and the upper shaft portion 314. The lower inner end disk 350 is positioned between the lower end disk 328 and the lower wall 308 of the housing 302 and is annularly shaped to fit around the lower shaft portion 316. An optional lower inner radial bearing 351 is located between the lower inner end disk 350 and the lower shaft portion 316. The upper and lower inner end disks 348 and 350 have a diameter that is greater than the diameter of the disks 320 such that the inner shroud 344 effectively encloses the rotor 312.

Similarly, the outer shroud 345 includes an upper outer end disk 354, a lower outer end disk 356, and a porous outer membrane 358. The porous outer membrane 358 extends between the outer edges of the upper and lower outer end disks 354 and 356. The upper outer end disk 354 is positioned between the upper inner end disk 348 and the upper wall 306 and is annularly shaped to fit around the upper shaft portion 314. An optional upper outer radial bearing 355 is located between the upper outer end disk 354 and the upper shaft portion 314. The lower outer end disk 356 is positioned between the lower inner end disk 350 and the lower wall 308 of the housing 302 and is annularly shaped to fit around the lower shaft portion 316. An optional lower outer radial bearing 357 is located between the lower outer end disk 356 and the lower shaft portion 316. The upper and lower outer end disks 354 and 356 have a diameter that is larger than the upper and lower inner end disks 348, 350 such that the outer shroud 345 effectively encloses the inner shroud 344 and the rotor 312.

The fixed porous membrane 346 extends around the outer membrane 358 from the upper wall 306 to the lower wall 308 between the outer shroud 345 and the sidewall 304 of the housing 302. A space between the fixed porous membrane 346 and the sidewall 304 of the housing 302 forms an outlet plenum chamber 360. The outlet plenum chamber 360 has an outlet 362 in the upper wall 306 of the housing 302.

The inner porous membrane 352, the outer porous membrane 358, and the fixed porous membrane 346 include openings or pores (not shown) such that a fluid within the rotor chamber 310 may pass through the membranes 352, 358, 346. The membranes 352, 358, 346 may be formed from the same material as the disks 320 with holes or pores formed by, for example, cutting or stamping out of the material. The porous membranes 352, 358, and 346 may be formed by, for example, casting or 3D printed utilizing any suitable material such as, for example, titanium or any suitable metal or plastic. Alternatively, the porous membranes 352, 358, 346 may be formed from a wire mesh, or a naturally porous substance, such as a fabric, which may be reinforced by, for example, metal inserts, or any other suitable material.

A first bearing 364 is located between the lower end disk 328 of the rotor 312 and the lower inner end disk 350 of the inner shroud 344. A second bearing 366 is located between the lower inner end disk 350 and the lower outer end disk 356 of the outer shroud 345. A third bearing 368 is located between the lower outer end disk 356 and the lower wall 308 of the housing.

Figure 4A:
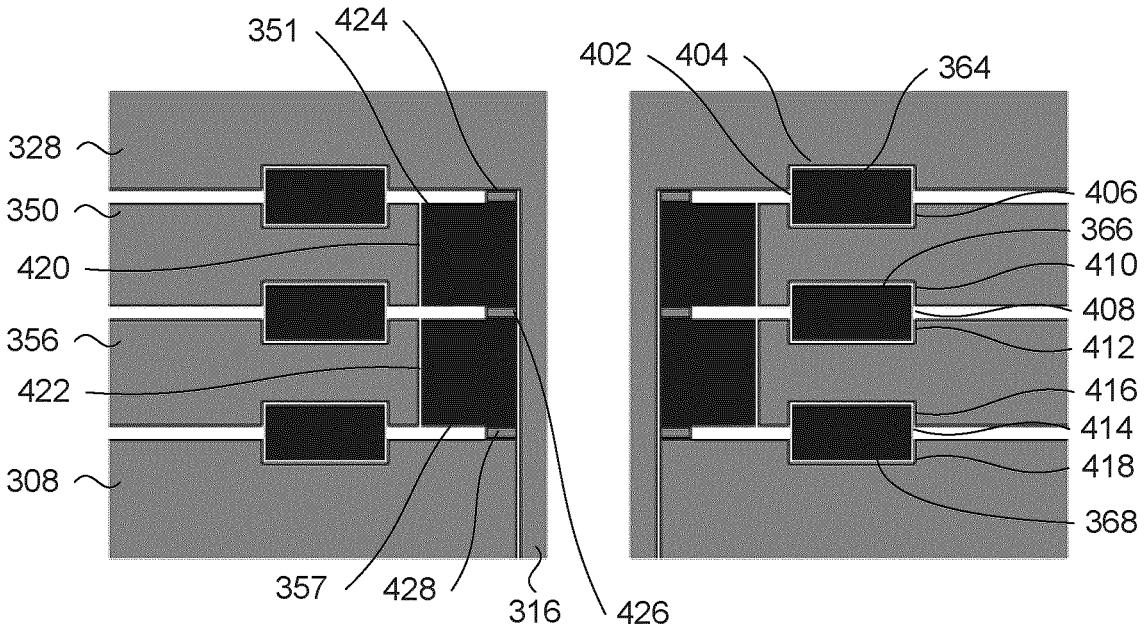
FIG. 4A is an enlarged sectional view of a portion of the shear flow pump according to the embodiment shown in FIG. 3.

Referring to FIG. 4A, an enlarged view of the arrangement of lower inner bearing 351, the lower outer bearing 357, the first bearing 364, the second bearing 366, and the third bearing 368 is shown. The first bearing 364 sits within a first cavity 402 formed by a notch 404 in the lower end disk 328 and a notch 406 in the inner end disk 350 that cooperates with the notch 404. The second bearing 366 sits within a second cavity 408 formed by a notch 410 in the lower inner end disk 350 and a notch 412 in the lower outer end disk 356 that cooperates with the notch 410. The third bearing 368 sits within a third cavity 414 formed by a notch 416 in the lower outer end disk 356 and a notch 418 in the lower wall 308 of the housing 302 that cooperates with the notch 416.

The lower inner radial bearing 351 is located in a first gap 420 between the inner edge of the lower inner end disk 350 and the lower shaft portion 316. The lower outer radial bearing 357 is located in a second gap 422 between the inner edge of the lower outer end disk 356 and the lower shaft portion 316. A first spacer 424 is located between the lower inner radial bearing 351 the end disk 328, a second spacer 426 is located between the lower inner radial bearing 351 and the lower outer radial bearing 357, and a third spacer 428 is located between the lower outer radial bearing 357 and the lower wall 308 of the housing 302.

Figure 4B:
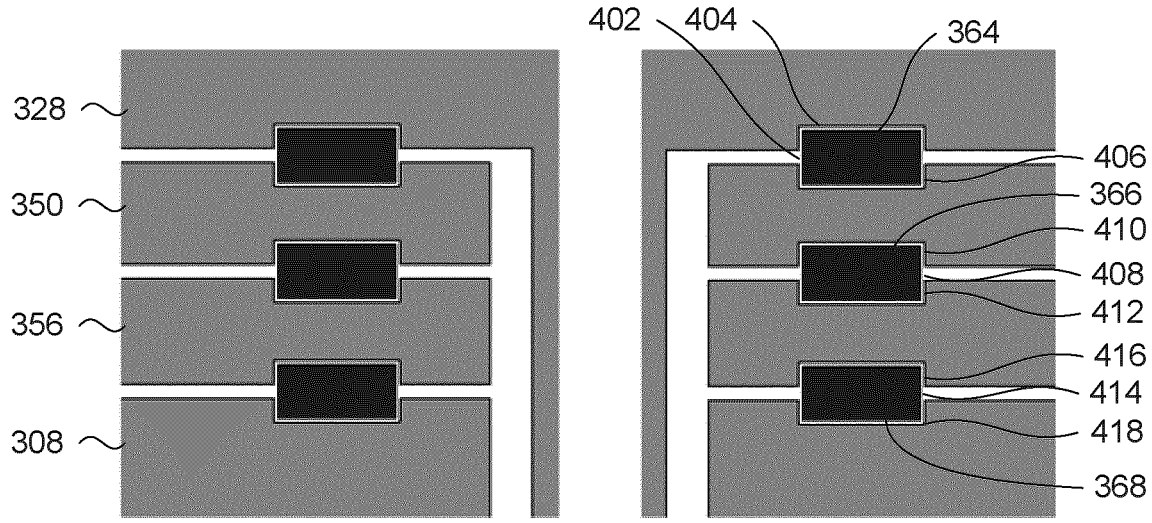
FIG. 4B is an enlarged sectional view of a portion of a shear flow pump according to an alternative embodiment to the embodiment shown in FIG. 3.

FIG. 4B shows an alternative arrangement in which the lower inner radial bearing 351 and the lower outer radial bearing 357 are omitted. In this alternative arrangement, the inner shroud 344 and the outer shroud 345 are fully supported by the first bearing 364, the second bearing 366, and the third bearing 368. In this case each bearing shown in FIG. 4B may be required to be of a type that can support both axial and radial loads.

Similar to the arrangement shown in FIGS. 4A and 4B, a fourth bearing 370 is located between the upper end disk 326 of the rotor 312 and the upper inner end disk 348 of the inner shroud 344; a fifth bearing 372 is located between the upper inner end disk 348 and the upper outer end disk 354 of the outer shroud 345; and a sixth bearing 374 is located between the upper outer end disk 354 and the upper wall 306 of the housing 302. Further, similar to arrangement shown in FIG. 4A, an optional upper inner radial bearing 349 is located between the upper inner end disk 348 and the upper shaft portion 314, and the optional upper outer radial bearing 355 is located between the upper outer end disk 354 and the upper shaft portion 314. The arrangements of the bearings 349, 355, 370, 372, and 374 mirrors the structure described above with reference to FIGS. 4A and 4B and, therefore, is not further described.

The bearings 364-374 may be, for example, carbon fiber rings, electrodynamic homopolar levitating bearings, or any other type of suitable bearings, or a mixture of bearing types. The bearings 364-374 locate the inner shroud 344 and outer shroud 345 with respect to the housing 302 and the rotor 312 while facilitating the inner shroud 344 and the outer shroud 345 rotating substantially independent of the rotor 312 and the upper and lower end disks 326 and 328.

In the case in which the axis of the rotor 312 is mounted vertically or at an angle from horizontal, then bearings 364-374 may be required to support the weight of the rotor 312, upper shaft portion 314, and lower shaft portion 316. Further, an additional main thrust bearing (not shown) may also be included to support the full weight of the rotor 312, upper shaft portion 314, and lower shaft portion 316. Alternately, the axis of the rotor 312 is mounted horizontally. In the case in which the axis of the rotor 312 is mounted horizontally, the full weight of the rotor 312, upper shaft portion 314, and lower shaft portion 316 may be supported by bearings 334 and 339.

In operation, the lower shaft portion 316 is rotated by an externally applied torque such as, for example, by the motor 318 or by a turbine. The rotation of the lower shaft portion 316 causes the rotor 312 and the upper shaft portion 314 to rotate. Fluid enters the shear flow pump 300 through the upper inlet 341 in the upper shaft portion 314 and the lower inlet 342 in the lower shaft portion 316. Fluid passes into the rotor 312 through the central openings 343 and into the gaps 322 between the rotating disks 320. By viscous shear, the fluid in the gaps 322 is dragged by the rotating disks 320 causing the fluid to flow in a circular motion outward toward an edge of the disks 320 along a spiral path.

The fluid flowing out of the gaps 322 follows a path tangential to the edge of the disks 320, with a speed nearly equal to the speed that the edge of the disks 320 is moving due to the rotation of the rotor 312.

The inner shroud 344, the outer shroud 345, and the fixed porous membrane 346 form reduced relative velocity porous barriers between the rotor 312, which rotates at a relatively high speed, and the stationary sidewall 304 of the housing 302. In operation, the fluid exiting the rotating disks 320 flows over the inner membrane 352 and the outer membrane 358 produces viscous shear that causes the inner shroud 344 and the outer shroud 345 to rotate.

Each of the inner shroud 344 and the outer shroud 345 rotates at a speed intermediate the rotational speed of the surfaces on either side of the shroud. For example, the inner shroud 344 rotates at a speed intermediate the rotational speed of the rotor 312 and the rotational speed of the outer shroud 345. Similarly, the outer shroud 345 rotates at a speed intermediate the rotational speed of the inner shroud 344 and zero, which is the rotational speed of the fixed porous membrane 346.

Fluid that is accelerated outward by rotation of the rotor 312, toward the sidewall 304 passes through the inner membrane 352, the outer membrane 358, and the fixed porous membrane 346 in a stepwise flow. The angular velocity of the fluid that exits at the outer edges of the disks 320 of the rotor 312 is very large compared to the velocity of the fluid in the radial direction. The angular velocity component of the fluid is reduced by passing through each of the inner membrane 352, the outer membrane 358, and the fixed membrane 346. The fluid that exits the fixed membrane 346 has an angular velocity component that approaches zero. By reducing the angular velocity of the fluid exiting the rotor 312, the inner shroud 344, outer shroud 345, and the fixed membrane 346 convert the angular velocity into pressure (refer to Bernoulli's law).

The fluid passes through the fixed porous membrane 346 into the plenum chamber 360. The fluid in the plenum chamber 360 has increased static pressure relative to the fluid at the inlets 341, 342 due to the kinetic energy imparted to the fluid from the rotating disks 320, which is converted into pressure. The fluid in the plenum chamber 360 exits through the outlet 362. A regulator (not shown) may be provided at the outlet 362 to maintain a desired flow rate out of the shear flow pump 300.

Although FIG. 3 shows an inner shroud 344 enclosed within an outer shroud 345, which are both enclosed within a fixed porous membrane 346, alternatively only one of the inner and outer shrouds 344, 346 may be included, or more than two shrouds may be included, with or without the fixed porous membrane 346. Alternatively, only the fixed porous membrane 346 may be included.

Although FIG. 3 shows the rotor 312 coupled to an upper shaft portion 314 and a lower shaft portion 316, alternatively, the upper shaft portion 314 may be omitted and the rotor 312 would be coupled to the lower shaft portion 316 in a cantilevered fashion.

Figure 5:
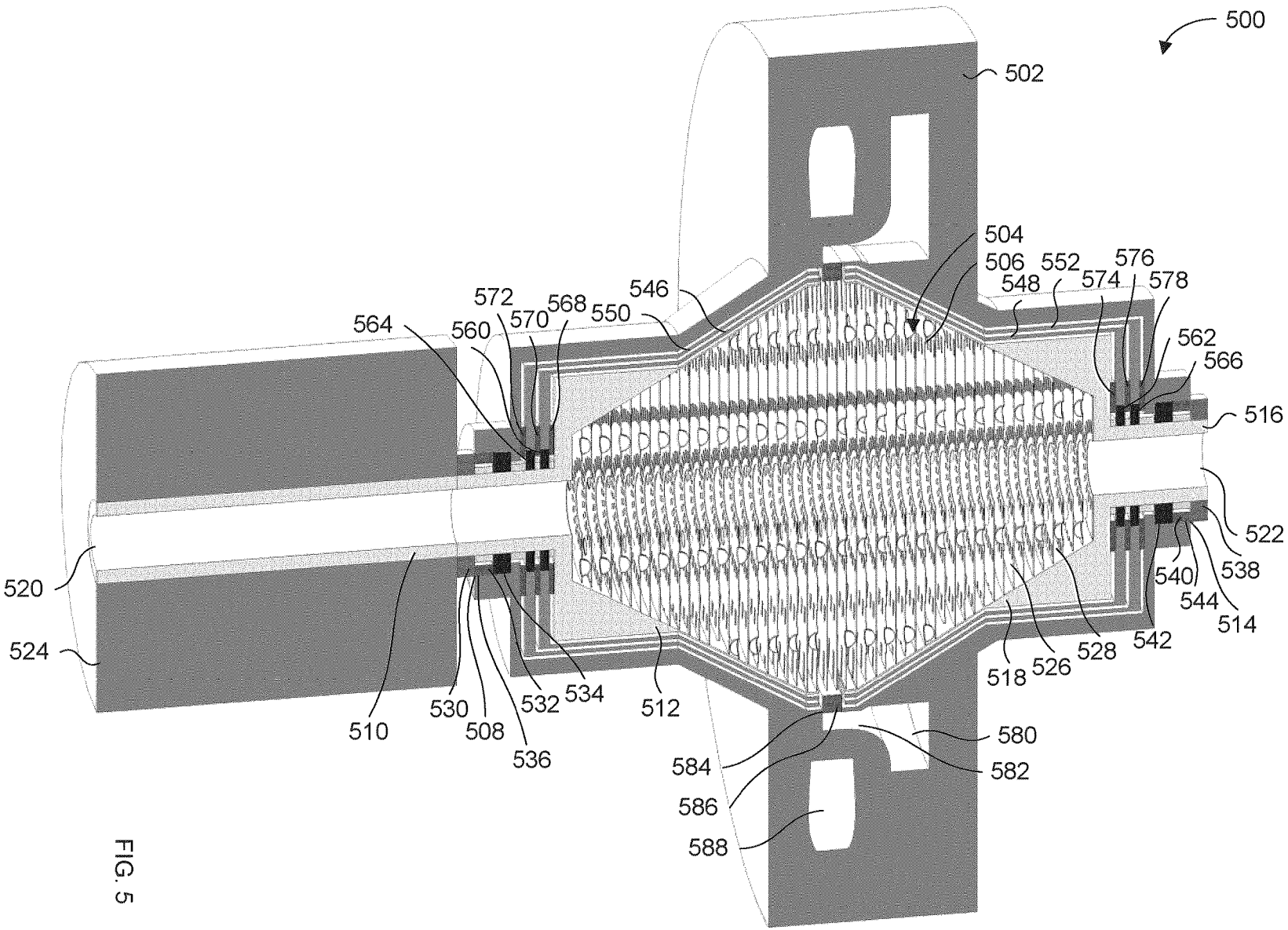
FIG. 5 is a cutaway perspective view of a shear flow device according to an embodiment.

Referring now to FIG. 5, an example shear flow device 500 having a conically shaped rotor is shown. The shear flow device 500 is designed to reduce housing drag by utilizing a conically shaped rotor. Conical rotors reduce the surface area of the portion of the rotor at the largest radius, where the relative speed is highest, reducing energy lost through housing drag and increasing the efficiency of the rotor. Housing drag may be further reduced by the use of free-spinning porous shrouds around the rotor. Further, a high radial velocity between the disks may limit the efficiency of the device and its operating range. The conical shape may improve efficiency by reducing the radial fluid velocity between the disks 526 near the axis when compared to a similar rotor with a flat cylindrical shape.

The shear flow device 500 shown in FIG. 5 may be operated in either of a turbine mode or a pump mode. The shear flow device 500 includes a housing 502 that defines a rotor cavity 504. A rotor 506 is enclosed within the rotor cavity 504. The housing 502 includes a first shaft opening 508 through which a first shaft portion 510 extends into the housing 502 and couples to the rotor 506 by a first end cap 512. The housing includes a second shaft opening 514 through which a second shaft portion 516 extends into the housing 502 and couples to the rotor 506 by a second end cap 518.

The first shaft portion 510 and the second shaft portion 516 are hollow. The first shaft portion 510 includes a first axial port 520 and the second shaft portion 516 includes a second axial port 522.

In a pump mode, the first shaft portion is coupled to a motor 524 that rotates the first shaft portion 510, causing the rotation of the rotor 506. In a turbine mode, the motor may be replaced with a generator 524 that may, for example, convert the rotation energy produced by the device 500 into electricity.

The rotor 506 includes a plurality of disks 526 that are spaced apart to form gaps 528 between adjacent disks 526. The disks 526 are flat sheet disks of different diameters that are concentrically aligned. The disks 526 are arranged by diameter such that the rotor 506 has an overall conical shape, similar to two cones joined together at their bases. The disks 526 with the largest diameter located in the middle of the rotor 506 and the disks 526 with the smallest diameter are located at the outermost ends of the rotor 506 closest to the first and second shaft portions 510, 516. Alternatively, the rotor 506 of the shear flow device 500 may have an overall shape of a single cone similar to, for example, the rotors shown in FIG. 11.

Figure 6:
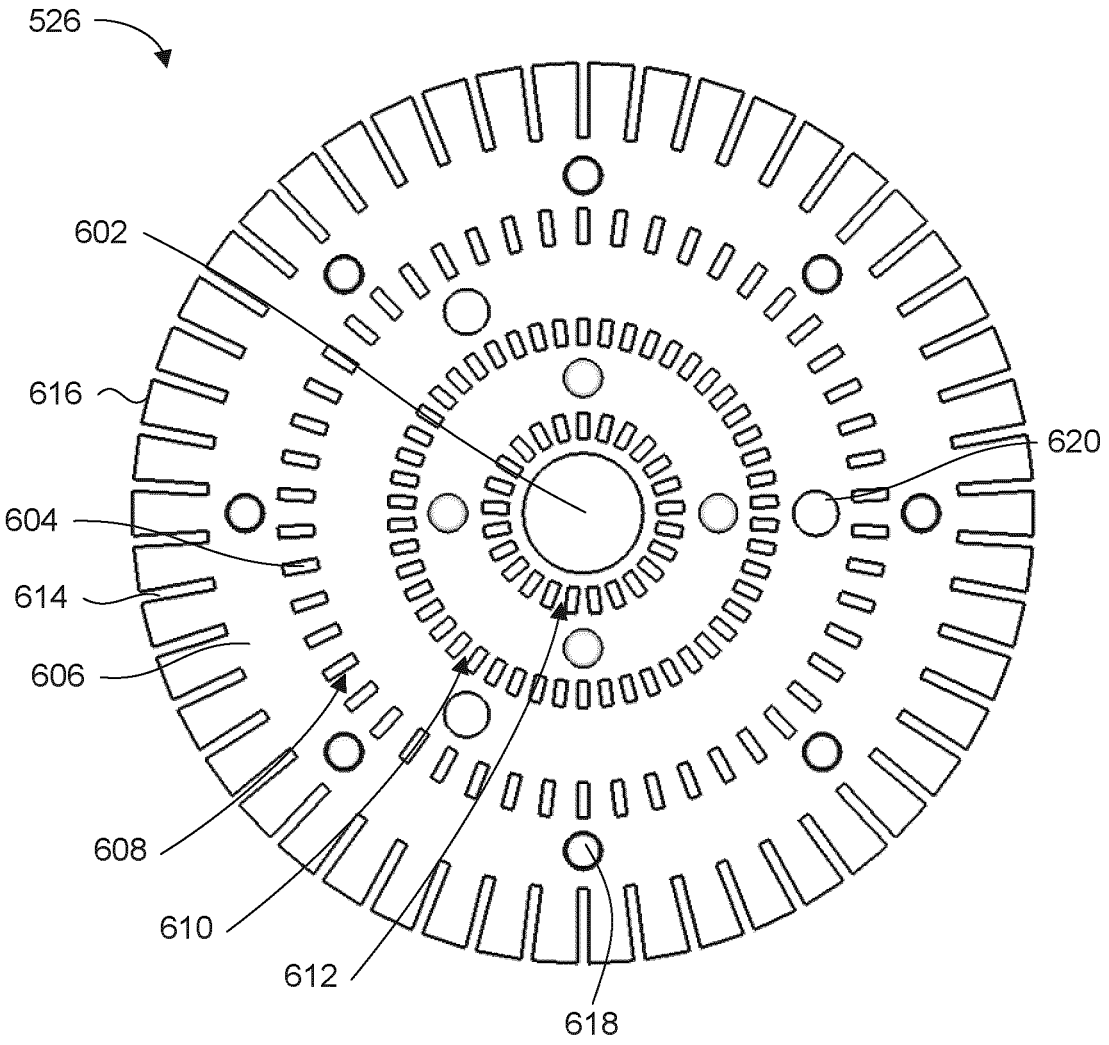
FIG. 6 is a plan view of a disk for the rotor of the shear flow device according to the embodiment shown in FIG. 5.

Referring now to FIG. 6, an example of a disk 526 suitable for use in the rotor 506 is shown. Each disk 526 has a central opening 602 to facilitate axial flow of a fluid between rotor 506 and the hollow first and second shaft portions 510, 516. Each disk 526 includes a plurality of disk apertures 604 over the flat surface 606 of the disk 526. The disk apertures 604 in the example disk 526 shown in FIG. 6 are arranged in a first ring 608, a second ring 610, and a third ring 612, however the disk apertures 604 may be arranged in any way over the flat surface 606 of the disk 526.

The disk 526 also includes notches 614 in the outer edge 616 of the disk 526. When the disk 526 is incorporated into the rotor 506, the disk apertures 604 and the notches 608 facilitate flow of a fluid through flat surface 606 of the disks 526 and at the outer edges 610.

The disk 526 includes a plurality of protrusions 618. When installed within a rotor, the protrusions 618 may, for example, space the disk 526 from an adjacent disk 526 to maintain the gap 528 between adjacent disks 526. Further, the protrusions 618 may alternatively, or additionally, extend from the surface of the disk 526 with different varying heights and may also function similar to a roughness on a flat disk, laminarising the flow of fluid over the disk 526. The protrusions 618 may be formed by, for example, stamping a sheet metal disk 526. Forming the protrusions 618 by stamping will form a corresponding indentation (not shown) on the back surface (not shown) of the disk 526. When disks 526 are installed in a rotor, the disks 526 may be rotated relative to an adjacent disk 526 such that the protrusions 618 of a disk 526 are not aligned with the indentations of the adjacent disk 526 in order to properly space the disks 526 apart.

The disks 526 include a plurality of throughbolt openings 620. When the disk 526 is installed within the rotor 506, throughbolts pass through the throughbolt openings 620 to couple the plurality of disks 526 together. The total number of throughbolt openings 620 is chosen such that, when the disks 526 are installed in the rotor 506, the disks 526 may be rotated relative to an adjacent disk such that the protrusions 618 of one disk 526 are offset from the indentations of the adjacent disk 526.

Figure 7:
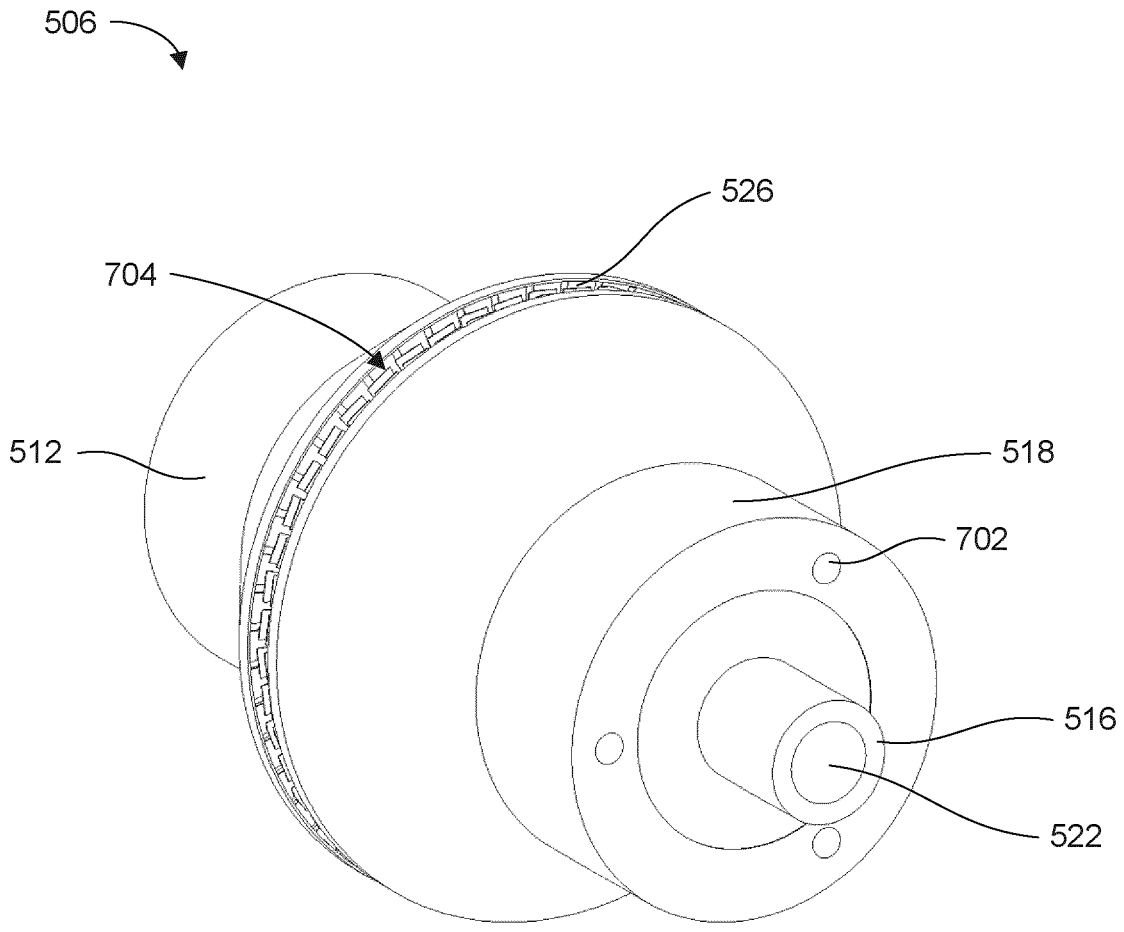
FIG. 7 is a perspective view of the rotor and end cap of the shear flow device according to the embodiment shown in FIG. 5.

The rotor 506 is coupled to the first and second shaft portions 510, 516 by first and second end caps 512, 518, respectively. Referring now to FIG. 7 with continued reference to FIG. 5, the arrangement of the rotor 506, the second shaft portion 516, and the second end cap 518 is shown.

The first endcap 512 is connected to the first shaft portion 510 and the second endcap 518 is connected to the second shaft portion 516. The first endcap 512 may be a separate element that is connected to the first shaft portion 512 by any suitable method, such as for example a threaded connection. Alternatively, the first endcap 512 and the first shaft element 510 may be formed in a single element. Similarly, the second endcap 518 may be a separate element or may be formed with the second shaft portion 516 in a single element.

The first and second end caps 512, 518 enshroud all of the disks 526 except those in a middle region 704 of the rotor 506 to inhibit fluid from recirculating around the outer edges of the disks 526. The end caps 512, 518 do not cover the middle region 704 so that the nozzles and the collector inlets, described below, are not obstructed. The shrouding of the rotor 506 by the first and second end caps 512, 518 also reduces drag between the rotor 506 and the walls of the housing 502.

Figure 9:
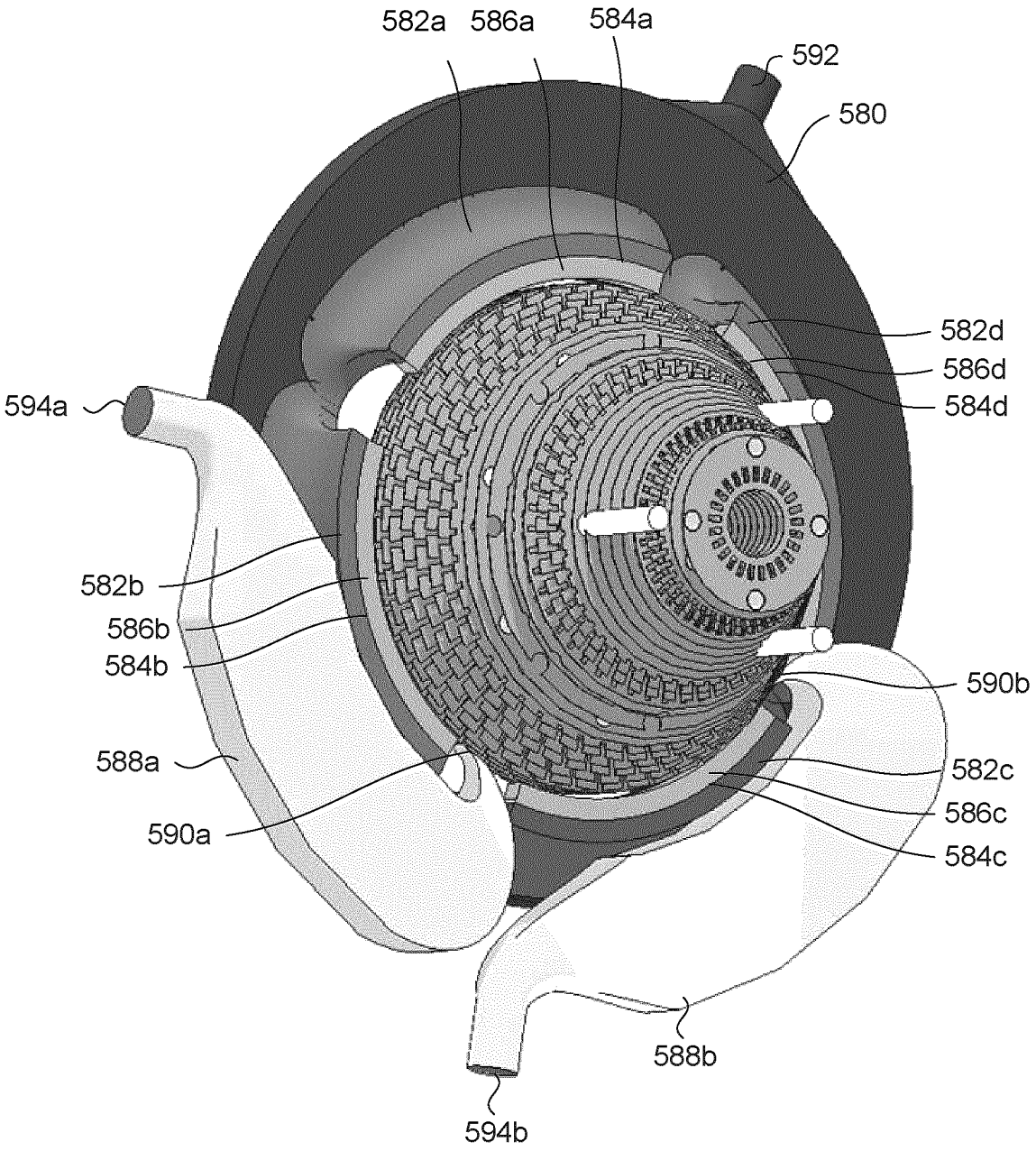
FIG. 9 is a perspective view of the rotor, collector plenum cavity, and nozzle plenum cavities of the shear flow device according to the embodiment shown in FIG. 5.

Throughbolts 702 extend from the first endcap 512 to the second endcap 518 through the throughbolt holes 620 of the larger diameter disks 526. The throughbolts 702 may not pass through the smaller diameter disks 526 located toward the ends of the rotor 506, as shown in FIG. 9. These smaller diameter disks 526 are held in place by compression of the first and second endcaps 512, 518.

Referring back to FIG. 5, the first shaft portion 510 includes a first lip 530. The first lip 530 presses against a first carbon face seal 532 to inhibit fluid from leaking out or into of the rotor cavity 504 around the first shaft portion. A first radial bearing 534 located between the first carbon face seal and the housing 502 supports the first shaft portion 510 within the housing 502. The first lip 530, first carbon face seal 532, and first radial bearing 534 are located within a first notch 536 in the first shaft opening 508. Similarly, the second shaft portion 516 includes a second lip 538 that presses against a second carbon face seal 540. A second radial bearing 542 is located between the second carbon face seal 540 and the housing 502. The second lip 538, second carbon face seal 540, and second radial bearing 542 are located within a second notch 544 in the second shaft opening 514 of the housing 502. The first and second radial bearings 534, 542 may be, for example, homopolar electrodynamic levitating bearings, aerodynamic bearings, or any other suitable type of bearing.

The shear flow device 500 includes first and second free-spinning inner shrouds 546, 548 and first and second free-spinning outer shrouds 550, 552. The first and second inner shrouds 546, 548 freely rotate in the space between the inner walls of the rotor cavity 504 and the rotor 506, and the space between the first and second endcaps 512, 518 and the rotor 506. The first and second outer shrouds 550, 552 freely rotate in the space between the first and second inner shrouds 546, 548 and the inner walls of the rotor cavity 504.

Similar to the shrouds 344, 345 of the shear flow pump 300 previously described, the free spinning shrouds 546, 548, 550, 552 reduce the drag between the housing 502 and the rotor 506. The shrouds 546, 548, 550, 552 are mounted as in a cantilevered manner with a gap between opposing shrouds at the middle region 704 of the rotor 506 to facilitate the fluid from the nozzles to be directed to the disks 526. If, for example, the turbine functionality is not desired then the shrouds 546, 548, 550, 552 could completely enclose the rotor 506 if some or all of their structure were made porous, similar to the shrouds 344, 345 of the shear flow pump 300 previously described.

The first and second inner shrouds 546, 548 are supported by respective first and second inner radial bearings 560, 562 located between the first and second inner shrouds 546, 548 and the first and second shaft portions 510, 516. Similarly, the first and second outer shrouds 550, 552 are supported by first and second outer radial bearings 564, 566 located between the first and second outer shrouds 550, 552 and the first and second shaft portions 510, 516. The first and second inner radial bearings 560, 562 and the first and second outer radial bearings 564, 566 may be, for example, homopolar electrodynamic levitating bearings, aerodynamic bearings, or any other suitable type of bearing.

Additionally, the first inner shroud 546 and the first outer shroud 550 are supported by a first thrust bearing 568 located between the first endcap 512 and the first inner shroud 546, a second thrust bearing 570 located between the first inner shroud 546 and the first outer shroud 550, and a third thrust bearing 572 located between the first outer shroud 550 and the housing 502. Similarly, the second inner shroud 548 and the second outer shroud 552 are supported by a fourth thrust bearing 574 located between the second endcap 518 and the second inner shroud 548, a fifth thrust bearing 576 located between the second inner shroud 548 and the second outer shroud 552, and a sixth thrust bearing 578 located between the second outer shroud 552 and the housing 502. The thrust bearings 568, 570, 572, 574, 576, and 578 may be located within notches that are formed similar to the arrangement of notches and bearings described above with reference to FIGS. 4A and 4B.

The thrust bearings 568, 570, 572, 574, 576, 578 may be, for example, homopolar electrodynamic levitating bearings, carbon fiber rings, ball bearings, or any other suitable type of bearing.

The housing 502 includes a collector plenum cavity 580 that includes a diffuser 582. The collector plenum is in fluid communication with the rotor cavity 504 by a plurality of collector ports 584. The collector ports 584 optionally include porous collector membranes 586. The housing 502 also includes a plurality of nozzle plenum cavities 588.

Figure 8:
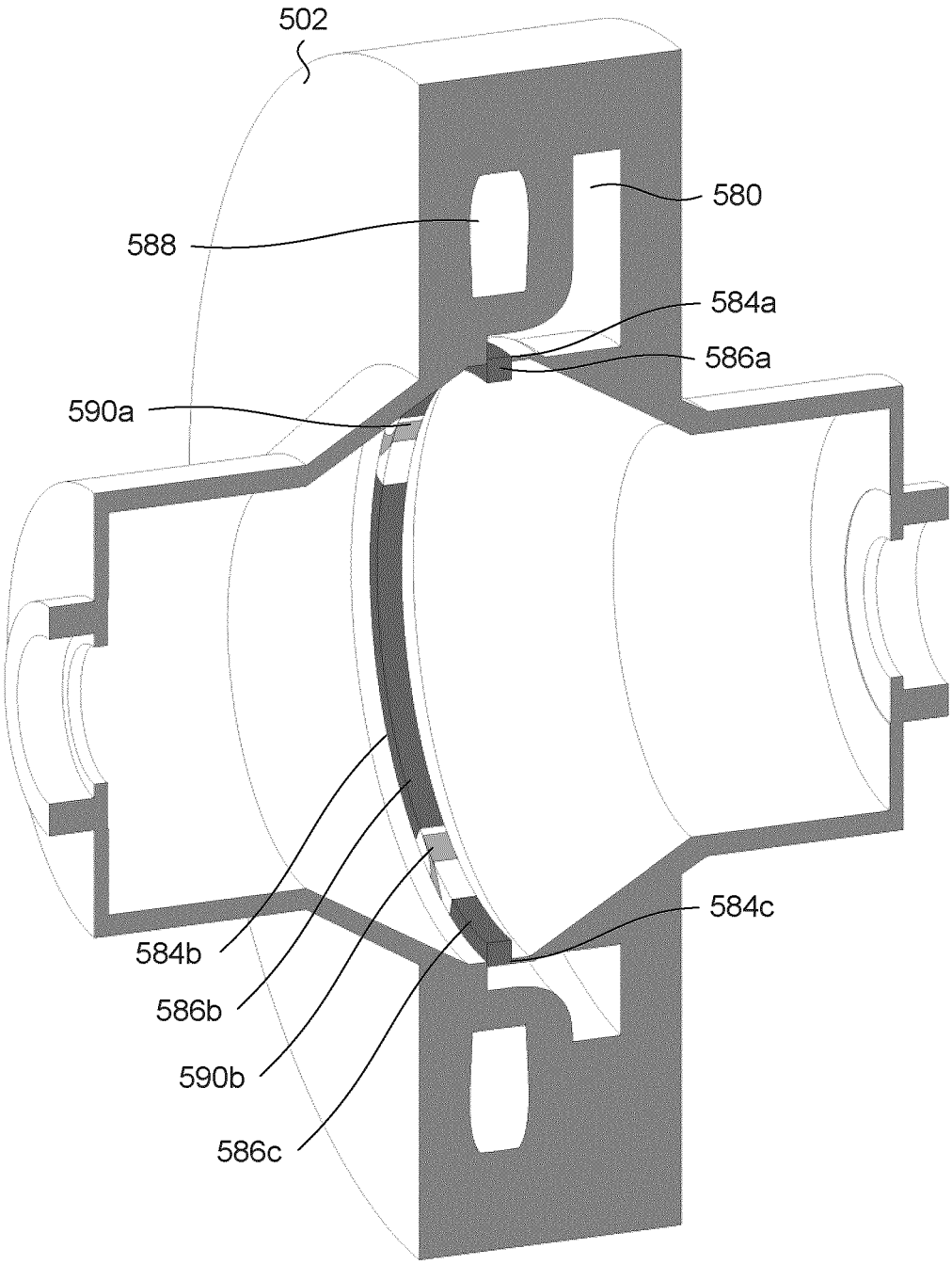
FIG. 8 is a cutaway perspective view of the housing of the shear flow device according to the embodiment shown in FIG. 5.

FIG. 8 shows three collector ports 584*a*, 584*b* and 584*c* of the shear flow device 500, each including a respective porous collector membrane 586*a*, 586*b*, and 586*c*. The shear flow device 500 includes an additional collector port 584 and porous membrane 586 that is not included view shown in FIG. 8. Two nozzle outlets 590*a*, 590*b* are shown. The two other nozzle outlets 590 are not shown in the view shown in FIG. 8.

Referring now to FIG. 9, a view of the collector plenum cavity 580, diffuser 582, porous membrane 584, and nozzles 586 are shown with the surrounding portions of the housing 502 cut away. Four porous membranes 586*a-d* are provided, one at each of four collector ports 584*a-d*. The collector ports 584*a-d* each have an associated diffuser cavity 582*a-d* that facilitate fluid communication between the collector ports 584*a-d* and the collector plenum cavity 580. The collector plenum cavity 580 includes an outlet 592. The porous membranes 586*a-d* may be formed of any suitable material, similar to the above described materials suitable for the porous membranes 352, 358, 346 of the shear flow pump 300 shown in FIG. 3. The porous membranes 586*a-d* form a surface close to the outer edges 616 of the disks 526. The fluid exiting the disks 526 during a pumping operation flows past the porous membranes 586*a-d* with a high angular velocity compared to its radial velocity. The high angular velocity fluid flowing past the porous membranes 586*a-d* parallel to the surface of the porous membranes 586*a-d*, forms a boundary layer. The cross sectional area of the collector ports 584*a-d* as seen by the fluid is large compared to the radial flow rate, allowing efficient flow of fluid through the porous collector membranes 586*a-d* into the collector ports 584*a-d* due to the low flow velocity in the radial direction.

The shear flow device 500 includes four nozzle plenum cavities 588, however two nozzle plenum cavities 588*a*, 588*b* are shown in FIG. 9, with the two other nozzle plenum cavities 588 omitted to provide an unobscured view of the collector plenum cavities 580. It is understood that two nozzle plenum cavities 588 in addition to the nozzle plenum cavities 588*a*, 588*b* shown in FIG. 9 are included in the shear flow device 500.

The nozzle plenum cavities 588*a*, 588*b* each include a respective nozzle inlet 594*a*, 594*b*. The porous membranes 586*a-d* are separated by spaces such that the fluid exiting nozzle outlets 590*a*, 590*b* may be directed to the disks 526 without obstruction by the porous membranes 586*a-d*. The nozzle outlets 590 may be evenly spaced around the rotor 506 such that the fluid jets exiting opposing nozzle outlets 590 balance the radial forces produced by each.

The nozzles 588 may be individually controllable to provide optimization control such that nozzles 588 activated in, for example, in steps as more flow is required by the turbine. Further, the fluid flow rate of each nozzle 588 may be regulated to provide finer flow control.

When the shear flow device 500 is operated as a turbine, fluid enters through the nozzle inlets 594. The fluid slows and expands in the nozzle plenum cavities 588, facilitating a more uniform velocity distribution of the fluid jet that exits the nozzle outlets 590. The nozzle inlets 594 must be large enough to accommodate sufficient flow to ensure the fluid does not become supersonic within the plenum chamber prior to exiting the nozzle outlets 590. The fluid exits the nozzle outlets 590 as a high speed fluid jet in a direction tangential to the edges 616 of the disks 526. Due to viscous shear, the fluid drags the disks 526, increasing the angular velocity of the disks 526 and applying a torque to the first and second shaft portions 510, 516. The fluid flows inward through the gaps 528, following a spiral path, until the fluid passes through the rotor 506 into the first and second shaft portions 510, 516 via the central openings 602 in the disks 526. The fluid flows through the first and second shaft portions 510, 516 towards the first and second axial ports 520, 522, exiting the shear flow device 500. The torque applied to the first and second shaft portions 510, 516 causes the shaft portions 510, 516 to rotate, which is turn may cause rotation of generator 524 coupled to one of the first shaft portion 510. The generator may generate electricity or otherwise utilize the kinetic energy generated by the rotated shaft. To increase the efficiency of the shear flow device 500, the braking torque applied to one or both of the first and second shaft portions 510, 516 by the generator 524 may be regulated. Additionally, or alternatively, the efficiency of the shear flow device may be increased by controlling the fluid flow rate through the nozzles plenum cavities 588.

When operating the shear flow device 300 in a pump mode, the motor 524 rotates the first shaft portion 510, which rotates the rotor 506. Fluid enters the first shaft portion 510 and the second shaft portion 516 through the first and second axial ports 520, 522. The fluid flows through the first and second shaft portions 510, 516 into the rotor 506 via the central openings 602. The fluid flows into the gaps 528 between the disks 526. The shear force applied to the fluid from the rotating disks 526 drags the fluid in the gaps 528 in a spiral motion toward the outer edges 616 of the disks 526. At the outer edges 616 of the disks 526, the fluid flows through the apertures and the notches 614 in the disks 526 toward the middle of the rotor 506. The first and second endcaps 512, 518 inhibit fluid from recirculating between the disks 526 that are enclosed within the endcaps 512, 518 and reduces drag to the housing 502. The first and second inner shrouds 546, 548 and the first and second outer shrouds 550, 552 reduce the drag on the fluid due to the housing 502, similar to the shrouds 344, 345 described above. The fluid diffuses through the porous membranes 586 and into the collector ports 584 and collects in the collector plenum cavity 580. In the collector plenum cavity, the fluid expands and slows further before passing through the collector outlet 592. Regulators (not shown) may be included at the collector outlet 592 to control the efficiency and the flow rate through the shear flow device 500 when operated as a pump. Additionally, or alternatively, the angular velocity of the motor may also be regulated to control the flow rate and efficiency of the shear flow device 500 when operated as a pump.

Figure 10A:
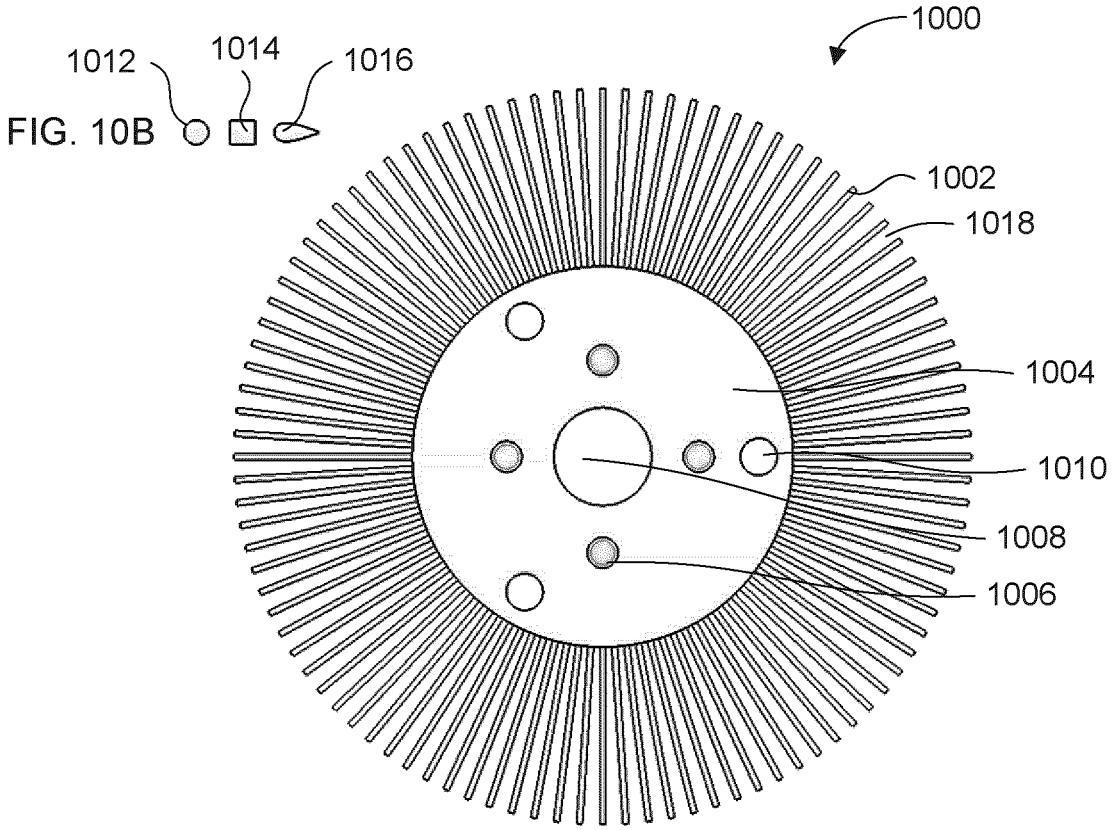
FIG. 10A is a plan view of an alternative disk for the rotor of the shear flow device according to an embodiment.

Referring to FIGS. 10A and 10B, an alternative design of a disk 1000 is shown. The disk 1000 may be incorporated into the shear flow device 500 shown in FIG. 5 in place of one or more disks 526 of the rotor 506.

The disk 1000 includes a plurality of bristles 1002 that extend radially outward from an inner disk 1004. The inner disk 1004 may include protrusions 1006. When installed within a rotor, the protrusions 1006 may, for example, space the disk 1000 from an adjacent disk 1000 to maintain a gap between the disks 1000. The protrusions 1006 may be formed similar to the formation of the protrusions 618 in the disks 526 described above with reference to FIG. 6. A central opening 1008 may be included at the center of the inner disk 1004 such that, when the disk 1000 is installed within a rotor coupled to a hollow shaft, fluid may flow from the hollow shaft into the rotor through the central openings 1008. The inner disk 1004 includes a plurality of throughbolt openings 1010 for accepting throughbolts that couple the disks 1000 together when installed within a rotor.

The bristles 1002 may have different cross sections. FIG. 10B shows examples of various cross sections of bristles 1002. Bristle 1012 has a circular cross section. The bristles 1012 may be formed from, for example, wire that is attached to the central disk 1004. Bristle 1014 has a square cross section. Bristle 1014 may be formed by, for example, laser cutting the bristles 1014 out of a solid disk, with the uncut portion of the disk forming the inner disk 1004. Bristle 1016 has a flattened cross section forming an airfoil. The airfoil cross section may improve the efficiency of the rotor by reducing drag.

When installed within a rotor, fluid may flow through the spaces 1018 between bristles 1002, facilitating axial fluid flow through the disks 1000. Further, the bristles 1002 function similar to a roughness on a flat disk, laminarising the flow of fluid over the disk 1000.

Figure 11:
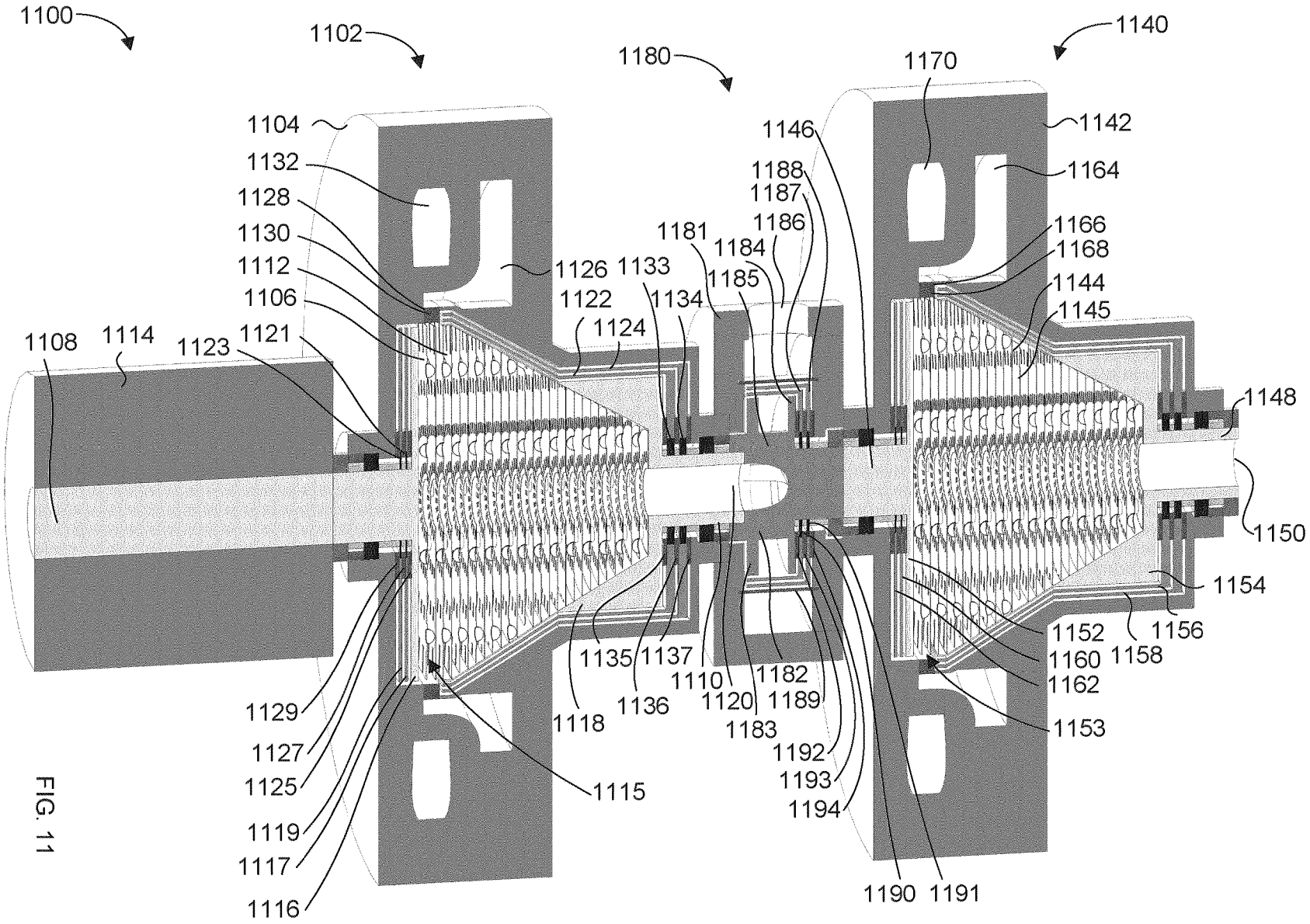
FIG. 11 is a cutaway perspective view of a multi-stage shear flow device according to an embodiment.

Referring now to FIG. 11 a multi-stage shear flow device 1100 is shown. The multi-stage shear flow device 1100 includes a first shear flow stage 1102 and a second shear flow stage 1140 that is coupled to the first shear flow stage by a connector stage 1180. Additional stages similar to the first and second shear flow stages 1102, 1140 may also be added to the shaft with additional connector stages 1180 between them.

The first shear flow stage 1102 includes a first housing 1104 that houses a first rotor 1106 in a first cavity 1105. The first flow stage 1102 also includes a first shaft portion 1108 and a second shaft portion 1110. The first rotor 1106 includes disks 1112 that are similar to the disks 526 of the rotor 506 of the shear flow device 500 previously described. Although the first rotor 1106 has the shape of a single cone whereas the rotor 506 has a double-cone shape, the first rotor 1106 is otherwise similar to rotor 506.

The first shaft portion 1108 is solid and may be coupled to a motor 1114 during pump operation and to a generator 1114 during turbine operation. The first shaft portion 1108 is mounted within the first housing 1104 similar to the mounting of the first shaft portion 510 in the shear flow device and therefore is not further described herein.

The first shaft portion 1108 is coupled to a first end disk 1116. A free-spinning first inner disk 1117 and a free-spinning first outer disk 1119 located between the first end disk 1116 and the housing 1104. The first inner disk 1117 and first outer disk 1119 rotate freely around the first shaft portion 1108. The first radial bearing 1121 is located between the first inner disk 1117 and the first shaft portion 1108 to support the first inner disk 1117. Similarly, a second radial bearing 1123 is located between the first outer disk 1119 and the first shaft portion 1108 to support the first outer disk 1119. The structure and installation of the first and second radial bearings 1121, 1123 are similar to the first inner radial bearing 560 and the first outer radial bearing 564 that are previously described with respect to the shear flow device 500 and are not further described herein.

A first thrust bearing 1125 is located in notch formed between the first end disk 1116 and the first inner disk 1117, a second thrust bearing 1127 is located in a second notch formed between the first inner disk 1117 and the first outer disk 1119, and a third thrust bearing 1129 is located in a notch formed between the first outer disk 1119 and the inner wall of the first cavity 1105 in the first housing 1104.

Similarly, a third radial bearing 1133 is located between the first inner shroud 1122 and the second shaft portion 1110, and a fourth radial bearing is located between the first outer shroud 1124 and the second shaft portion 1110. A fourth thrust bearing 1135 is located between the first end cap 1118 and the first inner shroud, a fifth thrust bearing 1136 is located between the first inner shroud 1122 and the first outer shroud 1124, and a sixth thrust bearing 1137 is located between the first outer shroud 1124 and the inner wall of the first cavity 1105 in the first housing 1104. The structure and installation of the radial bearings 1121, 1123, 1133, 1134 and the thrust bearings 1125, 1127, 1129, 1135, 1136, 1137 are similar to the structure and arrangement of the radial bearings 351, 357 and the thrust bearings 364, 366, 368 that are described above with reference to FIGS. 4A and 4B and are not further described herein.

The second shaft portion 1110 is coupled to a first endcap 1118 that encloses the disks 1112 of the rotor 1106 except for a first end portion 1115, similar to the second endcap 518 that exposes a central portion of the disks 704. The second shaft portion 1110 is hollow and includes a first axial port 1120. The second shaft portion 1110 is installed within the first housing 1104 similar to the installation of the second shaft portion 516 in the shear flow device 500 previously described and therefore is not further described herein.

Throughbolts (not shown) extend from the first end disk 1116 to the first endcap 1118 to couple the first shaft portion 1108 to the second shaft portion 1110 and to hold the disks 1112 of the rotor 1106 together, similar the throughbolts 702 of the shear flow device 500 previously described. The first shear flow stage 1102 includes a first inner shroud 1122 and a first outer shroud 1124 that surround the first endcap 1118, similar to the second inner shroud 548 and the second outer shroud 552 of the shear flow device 500 previously described. The structure and installation of the first inner shroud 1122 and first outer shroud 1124 is similar to the structure and installation previously described for the second inner shroud 548 and the second outer shroud 552 and therefore is not further describe herein.

The first housing 1102 includes a first collector plenum cavity 1126 having a plurality of first collector ports 1128. A first porous membrane 1130 may be included at each of the plurality of collector ports 1128. The first housing also includes a plurality of first nozzle plenum cavities 1132. The first collector plenum cavity 1126, first collector ports 1128, first porous membrane 1130, and first nozzle plenum cavities 1132 are similar to the collection plenum cavity 580, the collection ports 584, the porous membrane 586, and the nozzle plenum cavities 588 of the shear flow device 500 that is described above and therefore the first collector plenum cavity 1126, first collector ports 1128, first porous membrane 1130, and first nozzle plenum cavities 1132 are not further described herein.

The second shear flow stage 1140 includes a second housing 1142 that houses a second rotor 1144 having a plurality of disks 1145. The second rotor 1144 is coupled to a solid third shaft portion 1146 and a hollow fourth shaft portion 1148 that includes a second axial outlet 1150. The third shaft portion 1146 is coupled to a second end disk 1152 and the fourth shaft portion 1148 is coupled to a second endcap 1154. The second endcap encloses the disks 1145 of the second rotor 1144 except for a second end portion 1153, similar to the above described first end cap 1118. The second end disk 1152 is coupled to the second endcap 1154 by throughbolts (not shown) that pass through the disks 1145 of the second rotor 1144. A second inner shroud 1156 and a second outer shroud 1158 surround the second endcap 1154. A free-spinning second inner disk 1160 and a second outer disk 1162 rotate freely around the third shaft portion 1146 between the second end disk 1152 and the second housing 1142. The second housing 1142 includes a second collector plenum cavity 1164 having a plurality of second collector ports 1166 that include second porous membranes 1168. The second housing 1142 also includes a plurality of second nozzle plenum cavities 1170.

The structure and installation of the parts of the second shear flow stage 1140 is similar to the structure and installation of parts of the first shear flow stage 1102 described above and therefore is not further described herein.

The connector stage 1180 includes a connector housing 1181 that houses a connector rotor 1182. The connector stage 1180 couples the second shaft portion 1110 of the first shear flow stage to the third shaft portion 1146 of the second shear flow stage 1140. The connector stage 1180 also facilitates fluid transfer by connecting the first axial port 1120 to the nozzle inlets (not shown) of the second nozzle plenums 1170 of the second stage when the multi-stage shear flow device 1100 is operated in a turbine mode, and connecting the outlet (not shown) of the second collector plenum cavity 1164 to the first axial port 1120 when the shear flow device 1100 is operated in a pump mode.

The connector rotor 1182 connects to the second shaft portion 1110 of the first shear flow stage 1102 at a first connector disk 1183 by a threaded connection or other suitable connection. The connector rotor 1182 connects to the third shaft portion 1146 of the second shear flow stage 1140 by a second connector disk 1184 by a threaded connection or other suitable connection. Between the first connector disk 1183 and the second connector disk 1184 are impellers 1185.

Figure 12A:
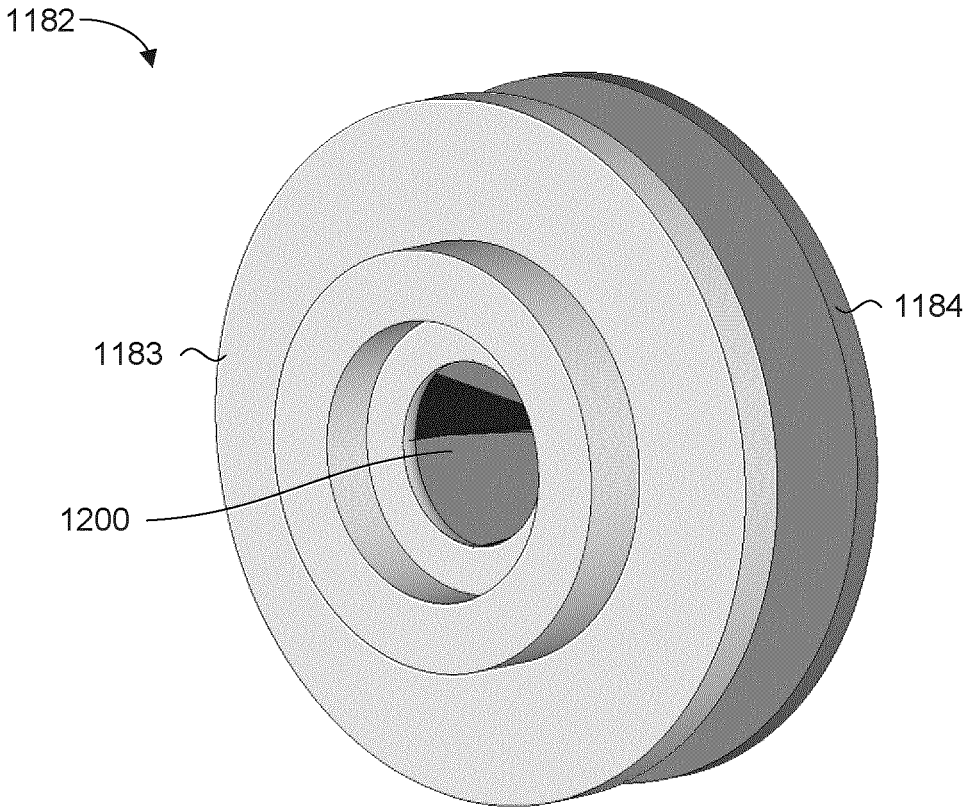
FIG. 12A is a perspective view of a collector turbine of the multi-stage shear flow device according to the embodiment shown in FIG. 11.
Figure 12B:
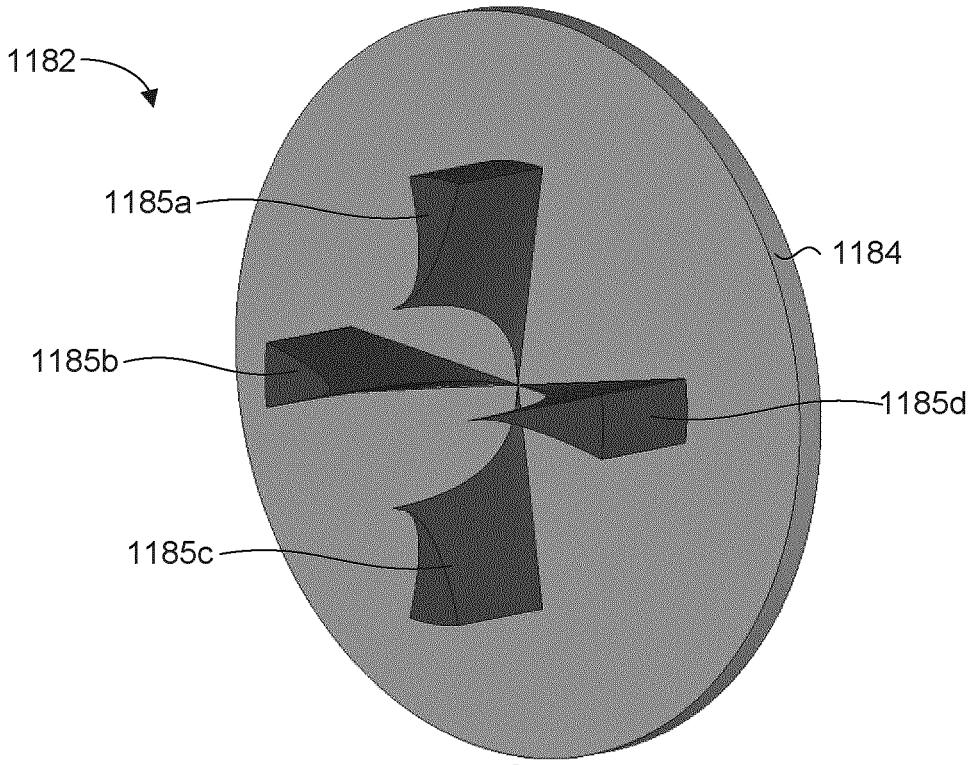
FIG. 12B is a perspective view of the collector turbine shown in FIG. 12A with a portion cut away.

Referring to FIG. 12, an enlarged view of the collector rotor 1182 is shown. The first connector disk 1183 includes an opening 1200 for fluid to flow between the connector rotor 1182 and the first axial port 1120 of the second shaft portion 1110. The impellers 1185 are intended to be designed to facilitate fluid flowing through the connection stage 1180 while transferring torque from the second shaft portion 1110 to the third shaft portion 1146. Designs for the impellers 1185*a-d* shown in FIG. 12. For example, the example connector rotor 1182 shown in FIG. 12 includes four impellers 1185*a-d*, however the number of impellers 1185 may be more or less than four.

The connector rotor 1182 functions to facilitate radial flow of fluid into or out of the second shaft portion 1110 while transferring torque between the second shaft portion 1110 and the third shaft portion 1146. The impellers 1185*a-d* of the connector rotor 1182 shown in FIGS. 11 and 12 transfer torque between the second shaft portion 1110 and the third shaft portion 1146 while facilitating fluid to flow radially into or out of the hollow second shaft portion 1110. The impellers may be shaped to reduce the drag on fluid flow through the connector rotor 1182.

The connector rotor 1182 may have a shape and arrangement different than that shown in FIGS. 11 and 12 provided that the arrangement transfers torque between the second shaft portion 1110 and the third shaft portion 1146 and facilitates fluid to flow between the first axial port 1120 and the connector port 1186. For example, an alternative embodiment of the connector rotor 1182 may be provided by a hollow shaft that connects the second shaft portion 1110 to the third shaft portion 1146 and includes holes that facilitate radial flow of fluid into or out of the hollow shaft.

The connector housing 1181 includes a connector port 1186 for fluid to flow into and out of the connector housing 1181. An inner connector shroud 1187 enshrouds the connector rotor 1182. An outer connector shroud 1188 enshrouds the connector rotor 1182 and the inner connector shroud 1187. A fixed connector membrane 1189 enshrouds the connector rotor 1182, the inner connector shroud 1187 and the outer connector shroud 1188. The inner connector shroud 1187 and the outer connector shroud 1188 have a cantilever structure similar to the first inner shroud 1122 and first outer shroud 1124 of the first shear flow stage 1102. The shrouds 1187, 1188, 1189 function similar to the shrouds previously described and therefore are not further described herein.

A first connector radial bearing 1190 is located between the inner connector shroud 1187 and the connector rotor 1182 to support the inner connector shroud 1187. A second connector radial bearing 1191 is located between the outer connector shroud 1188 and the connector rotor 1182 to support the connector shroud 1187. The structure and installation of the first and second radial bearings 1190, 1191 are similar to first and second radial bearings 1121, 1123 of the first shear flow stage 1102 and are not further described herein.

A first connector thrust bearing 1192 is located in a notch formed between the second connector disk 1184 and the inner connector shroud 1187. A second connector thrust bearing 1193 is located in a notch formed between the inner connector shroud 1187 and the outer connector shroud 1188. A third connector thrust bearing 1194 is located in a notch formed between the outer connector shroud 1188 and the connector housing 1181. The structure and installation of the first, second, and third connector thrust bearings 1192, 1193, 1194 are similar to first, second, and third thrust bearings 1125, 1127, 1129 of the first shear flow stage 1102 and are not further described.

The multi-stage shear flow device 1100 may be operated in a turbine mode, in which case the connector port 1186 is coupled the nozzle inlets (not shown) of the second nozzle plenums 1170 of the second shear flow stage 1140 and a generator 1114 is coupled to the first shaft portion 1108.

In operation in the turbine mode, a high pressure fluid enters the nozzle inlets (not shown) of the first nozzle plenum cavities 1132 of the first shear flow stage 1102. The fluid exits the first nozzle plenum cavities 1132 through nozzle outlets (not shown) in a high speed jet directed tangentially to the outer edge of the disks 1112 of the first rotor 1106. As described previously, the fluid then flows radially inward through gaps between the disks 1112 causing rotation in the disks 1112 due to viscous shear. Rotation of the disks 1112 of the first rotor 1106 rotates the first and second shaft portions 1108, 1110, which transfers power to the generator 1114. The connection rotor 1182 transfers the torque from the second shaft portion 1110 to the third shaft portion 1146 of the second shear flow stage.

The fluid travels axially toward the collector stage 1180 through apertures and the central opening in the disks 1112, similar to the passage of fluid through the disks 526 as previously described. The fluid travels through the hollow second shaft portion 1110 and exits the first axial port 1120 into the connector housing 1181 through the connector port 1186 of the connector rotor 1182. The fluid then passes through the inner connector porous shroud 1187, the outer connector porous shroud 1188, and the fixed porous connector membrane 1189, reducing the angular velocity of the fluid in the connector housing 1181 before exiting through the connector port 1186. Fluid exiting the connector housing 1181 flows into the nozzle inlets (not shown) of the second nozzle plenum cavities 1170 and exits through nozzle inlets as a high speed jet directed at the disks 1145 of the second rotor 1144, similar the operation of the first shear flow stage described above. The fluid passes from the second rotor 1144 into the hollow fourth shaft portion 1148 and exits the multi-stage shear flow device 1100 through the second axial port 1150.

In operation in the pump or compressor mode, a motor 1114 is coupled to the first shaft portion 1108. The motor 1114 applies a torque that causes rotation of the first shaft portion 1108, the first rotor 1106, the second shaft portion 1110, the connector rotor 1182, the third shaft portion 1146, the second rotor 1144, and the fourth shaft portion 1148. A low pressure fluid enters the multi-stage shear flow device 1100 through the second axial port 1150 of the second shear flow stage 1140. The fluid flows into the second rotor 1144 and travels radially outward through second rotor 1144 as previously described. The fluid passes through the second porous membrane 1168 and into the second collector plenum cavity 1166. The fluid leaves the second collector plenum cavity 1166 through an outlet (not shown) and is transported to the connection port 1186 of the connector stage 1180. The fluid passes through the connector housing 1181 and into the first shear flow stage 1102 through the connector port 1186 and the first axial port 1120. The fluid flows into the first rotor 1106 and travels radially outward through the first rotor 1106 as previous described. The fluid passes through the first porous membranes 1130 into the first collection plenum cavity as a high pressure fluid.

The rotation direction of the shafts 1108, 1110, 1146, 1148 and the rotors 1106, 1144, 1182 may be the same in both of the turbine mode and the pump mode. In this case, the multi-stage shear flow device 1100 may be converted without stopping the rotation of shafts 1108, 1110, 1146, 1148. For example, from the pump mode to the turbine mode by changing the coupling of the connector stage from the second connector plenum cavity 1164 to the second plenum nozzle cavities 1170. This conversion may be provided by closing off the outlets (not shown) of the first and second collector plenum cavities 1126, 1164 and opening up the inlets of the first and second nozzle plenum cavities 1132, 1170.

When converted from one mode to the other, the radial flow rate of the fluid flow with the first stage 1102, the second stage 1140 and the connector stage 1180 slows to zero and before increasing in the opposite direction. Because the radial flow velocity of the fluid in the multi-stage shear flow device is relatively small compared to the angular velocity, the transition from pump mode to turbine mode, or vice versa, may occur very quickly and without stopping the rotation of the shafts and rotors.

Alternatively, the multi-stage shear flow device 1100 may operate exclusively in a turbine mode. In this case the first and second collector plenum cavities 1126, 1164 may be omitted.

Alternatively, the multi-stage shear flow device 1100 may operate exclusively in a pump mode. In this case, the first and second nozzle plenum cavities 1132, 1170 may be omitted. Additionally, with the nozzles removed, the first and second inner end disks 1117, 1160 may be connected to the respective first and second inner shrouds 1122, 1156. Similarly, the first and second outer end disks 1119, 1162 may be connected to the respective first and second outer shrouds 1124, 1158.

Figure 13:
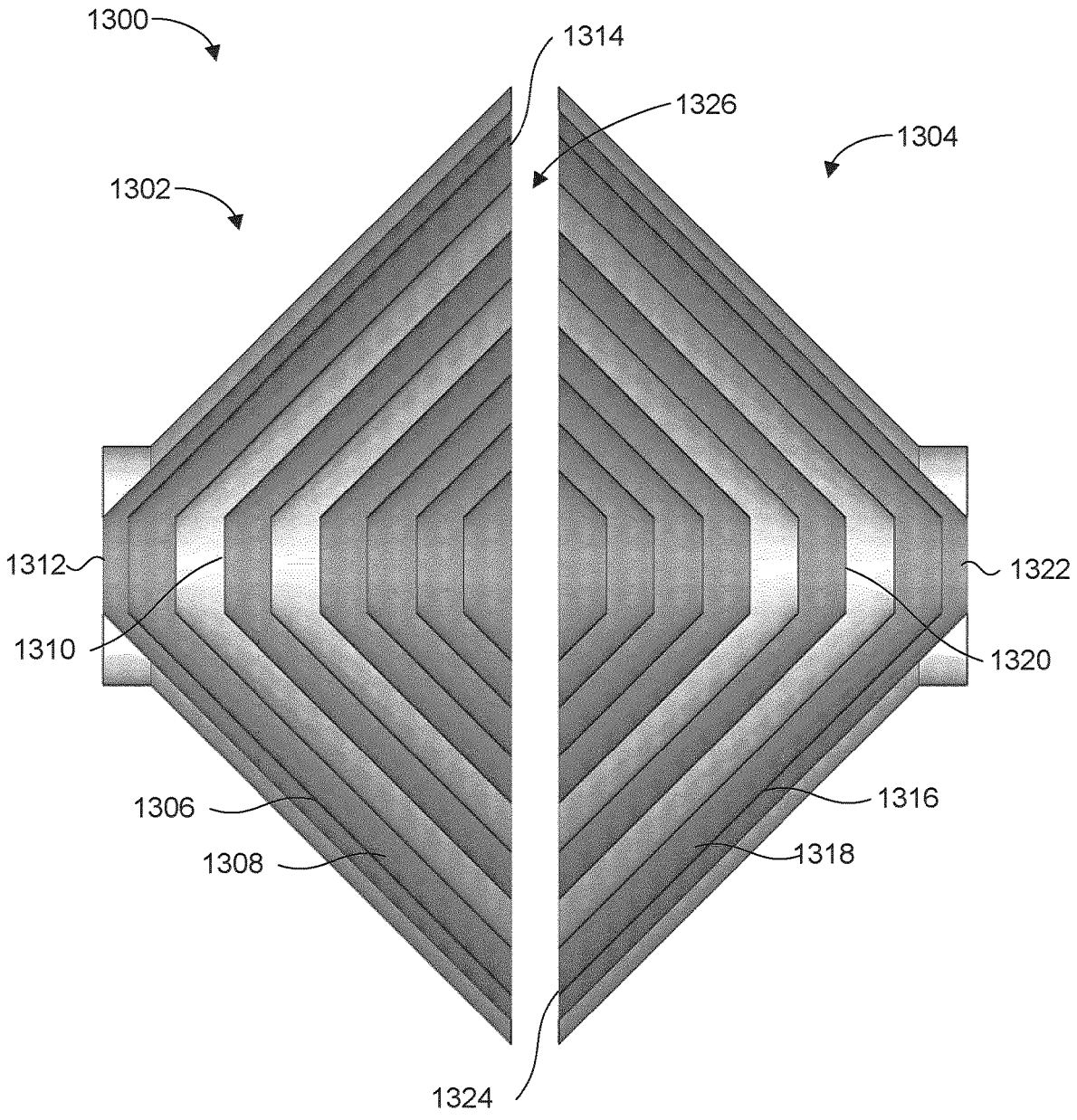
FIG. 13 is a sectional view of a rotor for a shear flow device according to another embodiment.

Referring now to FIG. 13, cross section of an alternative design of a conical shaped rotor 1300 is shown. The rotor 1300 may be incorporated into, for example, the shear flow device 500 in place of the rotor 506, or into the multi-stage shear flow device 1100 in place of the first rotor 1106 of the first shear flow stage 1102 and the second rotor 1144 of the second shear flow stage 1140.

The rotor 1300 includes a first portion 1302 and a second portion 1304 that mirrors the first portion 1302. The first portion 1302 includes a plurality of cones 1306 that are spaced apart by a gap 1308 between adjacent cones 1306. The cones 1306 include central openings 1310. The central openings 1310 of the cones 1306 are aligned with a first axial port 1312 at a first outer end 1314 of the rotor 1300. Fluid may flow axially through the first axial opening 1312 into the central openings 1310 and into the gaps 1308 between the cones 1306. The cones 1306 of the first portion 1302 may be coupled together by, for example, throughbolts (not shown) that pass through the cones 1306. The cones 1306 may include protrusions (not shown) that, for example, maintain a uniform distance of the gaps 1308 between cones 1306 as well as increase the surface roughness of the cones 1306, similar to the protrusions 324 extending from flat disks 320, as described above.

Similarly, the second portion 1304 includes a plurality of cones 1316 that are spaced apart by a gap 1318 between adjacent cones 1316. The cones 1316 of the second portion include central openings 1320. The central openings 1320 of the cones 1316 are aligned with a second axial port 1322 at a second outer end 1324 of the rotor 1300. Fluid may flow axially through the second axial opening 1322 into the central openings 1320 and into the gaps 1318 between the cones 1316. The cones 1316 of the second portion may be coupled together by throughbolts (not shown). The cones 1316 may include protrusions similar to the cones 1306 of the first portion 1302.

The first portion 1302 and the second portion 1304 are separated by a central gap 1326. The first portion 1302 and the second portion 1304 may be coupled together by, for example, throughbolts (not shown). The central gap 1326 may be maintained by, for example, notches in the throughbolts that couple the first portion 1302 and the second portion 1304 together, or by protrusions extending through the gap from the between the innermost cones 1306, 1316 of the first and second portions 1302, 1304.

The cones 1306, 1316 shown in FIG. 13 have differing diameters and a same included angle. The cones 1306, 1316 are arranged from largest diameter at the first and second outer ends 1314, 1324 to smallest diameter at the central gap 1326 such that smaller diameter cones 1306, 1316 are nested within larger diameter cones 1306, 1316.

By utilizing the rotor 1300 having cones 1306, 1316, rather than the flat disks, such as for example the disks 526 in the rotor 506 of the shear flow device 500 shown in FIG. 5, the fluid may flow axially through the gaps 1308, 1318 without utilizing apertures in flat disks. For example, for axial flow of a fluid between the disks 526 of the rotor 506, the fluid passes through apertures 604. Passing through the apertures results in turbulent eddies which may reduce the overall efficiency of the rotor. By utilizing cones 1306, 1316, apertures are not utilized for facilitating axial flow of fluid and efficiency is improved.

Further, the included angle of the cones 1306, 1316 may be varied to control the radial velocity of the fluid flowing over the cones 1306, 1316. Controlling the radial velocity of the fluid flow may be utilized to reduce radial flow frictional efficiency losses caused by radial fluid shear forces which results in drag that produces heat.

In the rotor 1300, in which the cones 1306, 1316 included the same included angle, the radial cross section "seen" by the radial velocity component of a fluid flowing through the gaps 1308, 1318 increases as the fluid flows outward.

The radial cross sectional area refers to a cylindrical surface area at a given radius. The cylindrical surface area is the distance between cones, or disks, at a particular radius R multiplied by $2\pi R$. If it is desired to reduce the variance in the cylindrical surface area as a function of the radius R between the shaft and the perimeter, then the distance between the disks (or cones) must decrease as a function of the radius R. One way to achieve a more uniform radial cross sectional surface is to form a rotor with multiple cones of different included angles and different diameters. Alternatively, a bristle brush rotor made of multiple diameter disks similar to what is shown in FIG. 10A may be utilized to provide more uniform radial cross sectional area. Alternatively, the cones 1306, 1316 may be made of a porous material or utilize apertures, or be made of a porous material that includes apertures. The pores and apertures facilitate the fluid flowing through the cones 1308, 1316 more readily from one gap 1308, 1318 to the next 1308, 1318. In this alternative, the axial and radial flow through the pores and apertures may still be accomplished with reduced turbulent eddies and higher efficiency due to the conical shape. All of these alternative arrangements may be utilized to fill the gap between the outer cones to enable laminar shear flow torque transfer while enabling a more uniform radial cross sectional area such that radial velocity components of the fluid flowing radially outward through are reduced.

Figure 14:
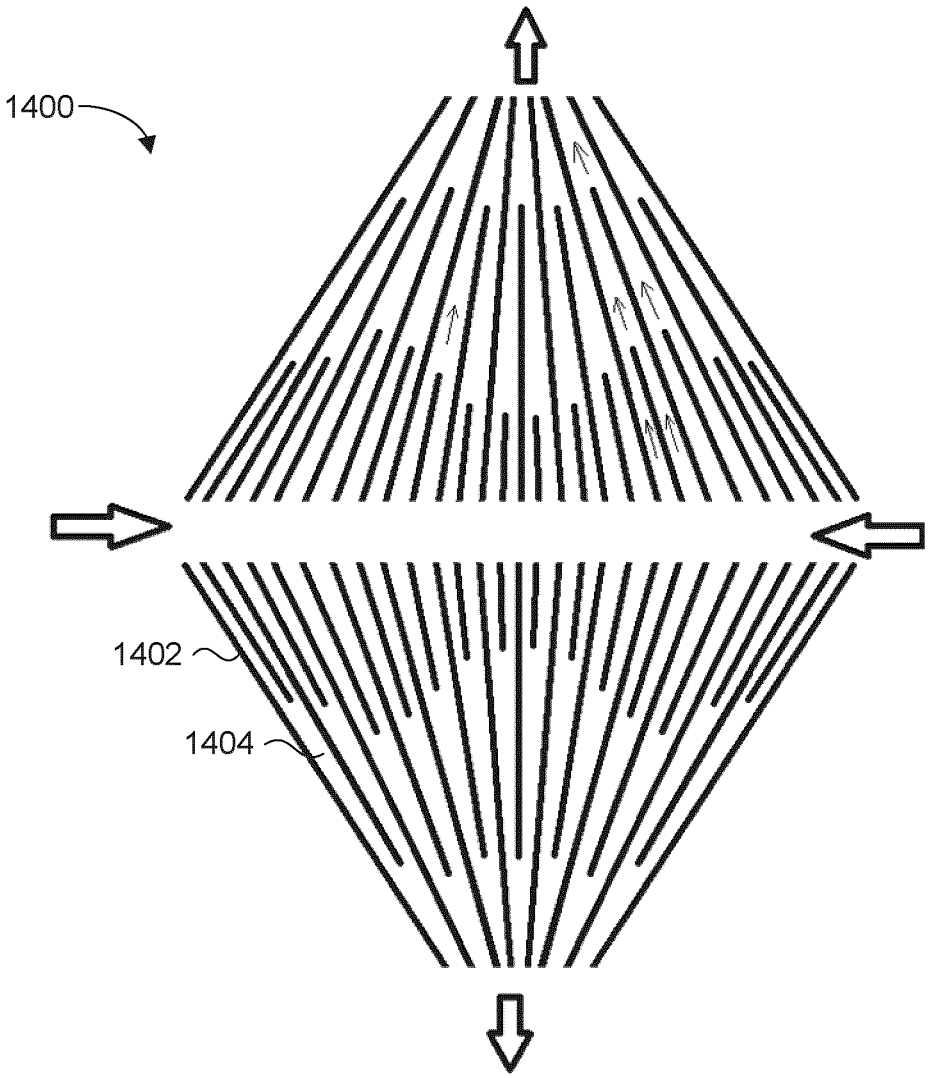
FIG. 14 is a sectional view of a rotor for a shear flow device according to another embodiment.

Referring now to FIG. 14, a cross section of an example rotor 1400 that includes cones 1402 of varying included angles and varying diameters. By including cones 1402 of varying included angle, the radial cross sectional area as "seen" by the radial velocity component of a fluid flowing through the gaps 1404 between cones 1402 may controlled to maintain a more constant radial cross sectional area as "seen" the fluid as the fluid moves radially outward. A more constant radial cross section maintains a more constant radial velocity of the fluid, improving the efficiency of the rotor compared to a rotor in which the radial velocity is less constant.

The material utilized to manufacture the rotors 1300 and 1400 may be, for example, Titanium Silicon Carbide, Titanium, Aluminium, Silicon Carbide, other high strength, creep resistant aeronautical turbine alloys. Alternatively, the material utilized may be a suitable low cost plastic or any other suitable material.

Figure 15:
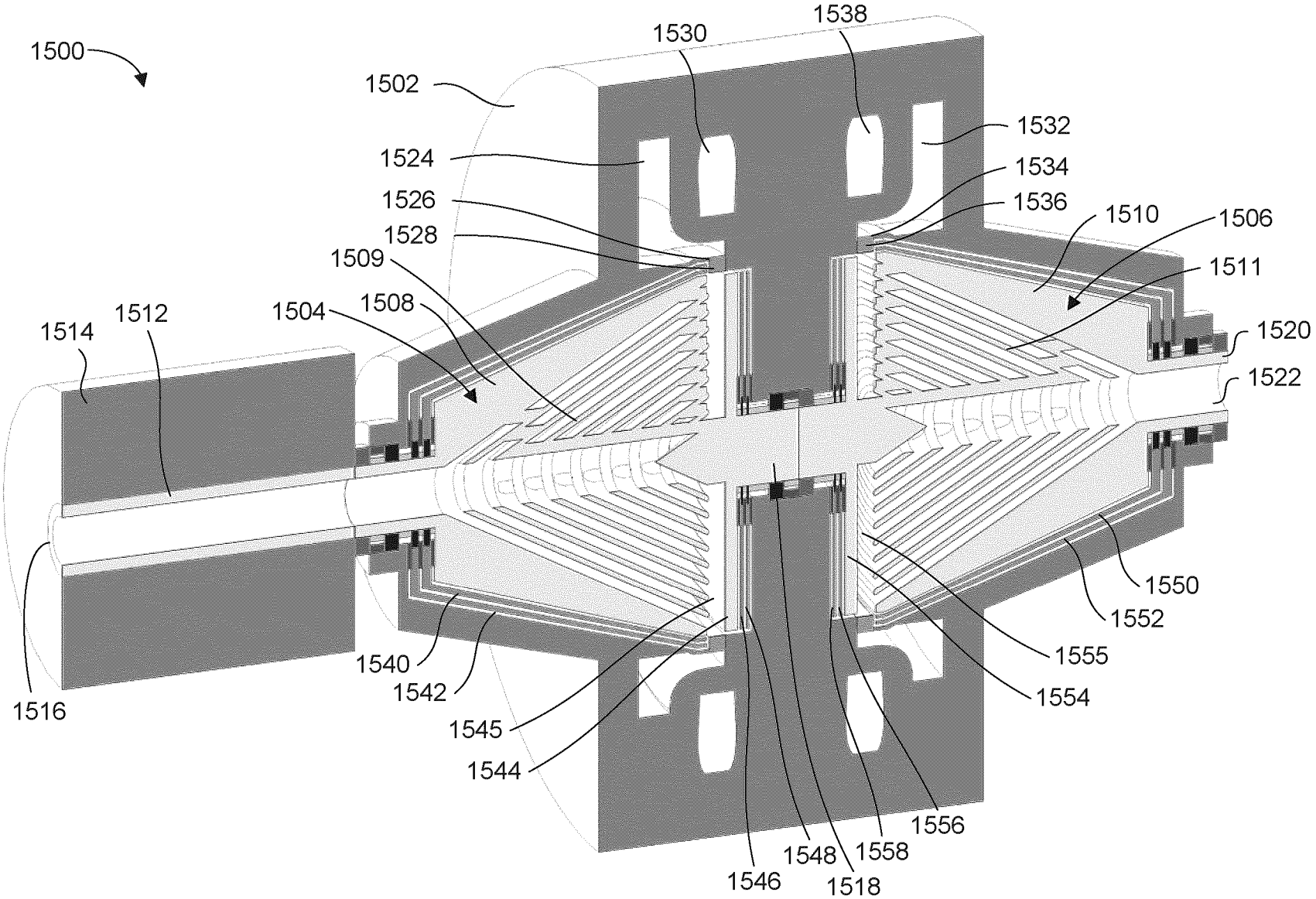
FIG. 15 is a cutaway perspective view of a two stage shear flow device according to an embodiment.

Referring now to FIG. 15, a two stage shear flow device 1500 is shown. The two stage shear flow device 1500 is similar to the shear flow device 1100 with the connector stage 1180 removed and with rotors comprising nested cones rather than disks. The shear flow device 1500 includes a housing 1502 that encloses a first rotor cavity 1504 and a second rotor cavity 1506.

A first rotor 1508 is housed within the first rotor cavity 1504 and a second rotor 1510 is housed within the second rotor cavity 1506. The first and second rotors 1508, 1510 include a plurality of nested cones 1509, 1511 that are similar to the cones 1306 of the rotor 1300 and are therefore not further described herein.

A hollow first shaft portion 1512 connects the first rotor 1508 to a motor 1514. The hollow first shaft portion 1512 includes a first axial port 1516. A solid second shaft portion 1518 connects the first rotor 1504 to the second rotor 1506. The second rotor 1506 is coupled to a hollow third shaft portion 1520 which includes a second axial port 1522.

The housing 1502 includes a first collector plenum cavity 1524 having a plurality of first collector inlets 1526 opening to the first rotor cavity 1504, with each opening having an optional porous membrane 1528. The housing 1502 also includes a plurality of first nozzle plenum cavities 1530 having nozzle outlets (not shown) opening into the first rotor cavity 1504. Similarly, the housing 1502 includes a second collector plenum cavity 1532, a plurality of second collector inlets 1534 having optional porous membranes 1536, and nozzle plenum cavities 1538 are associated with the second rotor cavity 1506. The collector plenum cavities 1524, 1532, collector inlets 1526, 1534, and nozzle plenum cavities 1530, 1538 are similar to similar elements of shear flow devices 500 and 1100 described previously and therefore are not further described.

A first end disk 1544 is coupled between the second shaft portion 1518 and the first rotor 1508 and is spaced from the first rotor 1508 to provide a gap 1545. A second end disk 1554 is coupled between the second shaft portion 1518 and the second rotor 1510 and is spaced from the first rotor to provide a gap 1555.

A first free-spinning inner shroud 1540 and a first free-spinning outer shroud 1542 are optionally included to enshroud the first rotor. A first free-spinning inner disk 1546 and first free-spinning outer disk 1548 are optionally located between the first end disk 1544 and the housing 1502. The installation and structure of the shrouds 1540, 1542, the first end disk 1544, and first free-spinning disks 1546, 1548 are the same as the structure and installation of these elements in the shear flow device 1100 previous described and are not further described herein.

An optional second inner shroud 1550, an optional second outer shroud 1552, second end disk 1554, an optional second inner disk 1556, and optional second outer disk 1558 are included in the second rotor cavity 1506. The structure and installation of the second inner shroud 1550, an optional second outer shroud 1552, second end disk 1554, an optional second inner disk 1556, and optional second outer disk 1558 is similar to the shrouds 1540, 1542, the first end disk 1544, and first free-spinning disks 1546, 1548 of the first rotor cavity 1504 and are not further described herein.

Figure 16A:
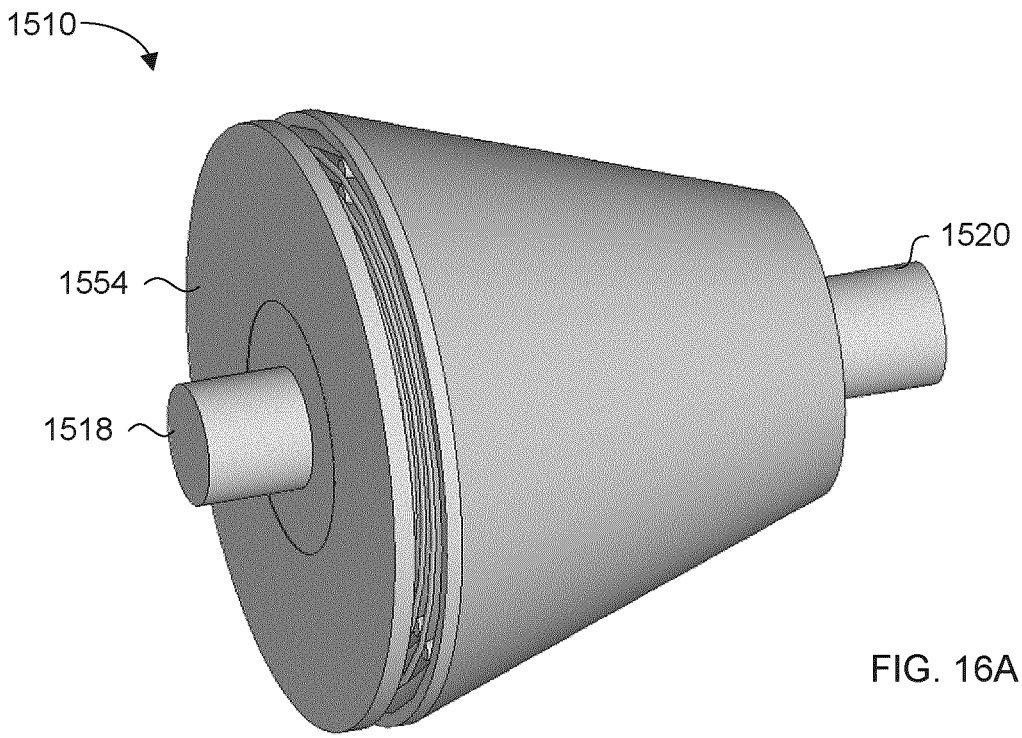
FIGS. 16A and 16B are perspective views of a rotor of the two stage shear flow device according to the embodiment shown in FIG. 15.
Figure 16B:
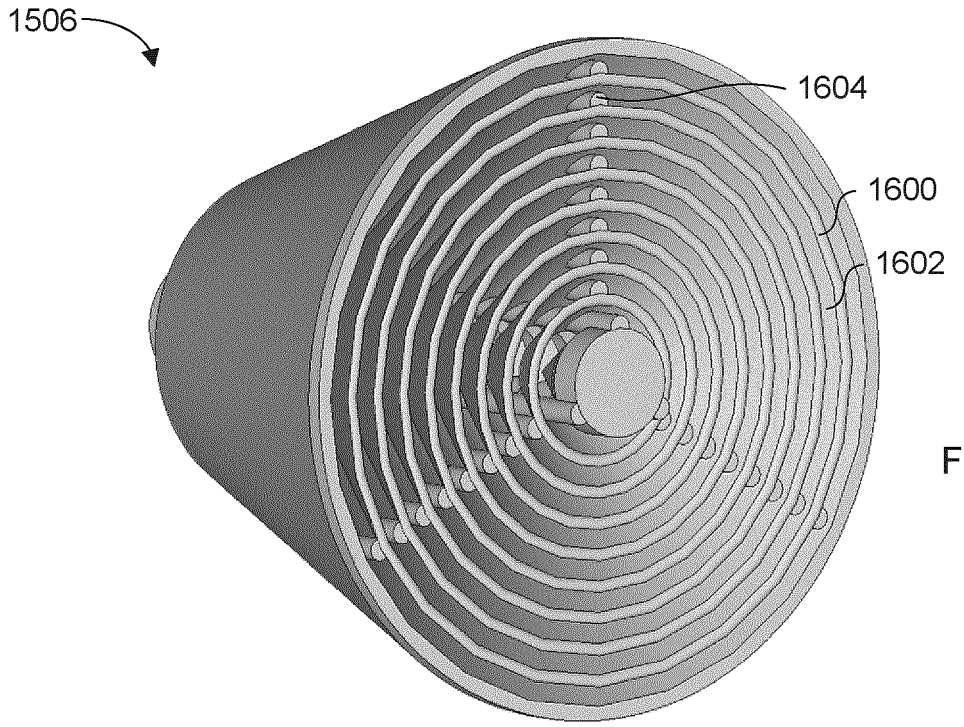

As noted above, the rotors 1508, 1510 are similar to the rotor 1300 described above. The rotors 1508, 1510 and the first and second end disks 1544, 1554 may be formed of a single piece by, for example, 3D printing or casting. FIG. 16A shows an example of the second rotor 1510 and second end disk 1554 formed by 3D printing. FIG. 16B shows the second rotor 1510 with the second end cap 1554 removed so that the structure within the rotor 1510 is visible. The first rotor 1508 and first end cap 1544 are structurally the same as the second rotor 1510 and the second end cap 1554.

The rotor 1510 includes a plurality of cones 1600 separated by gaps 1602. The cones 1600 have a same included angle and have decreasing diameters, as discussed above with reference to FIG. 13. The cones 1600 are connected together by connectors 1604 (see FIG. 16B).

The two stage shear flow device 1500 may be utilized as a reversible single stage compressor and turbine with, for example, the first rotor 1508 operating as a compressor, and the second rotor 1510 operating as a turbine that powers the compressor. In operation, fluid enters the second nozzle plenum cavities 1538, and exits as a high velocity jet, causing the second rotor 1510 to rotate and exits through the second axial outlet 1522, as is described previously. In one example, a combustible fuel enters the second nozzle plenum cavity, which is combined with compressed air. The fuel-air mixture is combusted in the nozzle plenum cavity, generating a high temperature exhaust jet that exits the nozzle outlets (not shown) and rotates the second rotor 1510.

The rotation of the second rotor 1510 causes the first rotor 1508 to rotate. A fluid to be pumped enters through the first axial port 1516 and travels into the first rotor 1508. The fluid travels radially outward though the gaps 1602 in the cones 1600 due to viscous shear caused by the rotation of the first rotor 1508. The high pressure fluid is collected in the first collector plenum cavity 1524, as describe previously.

Similarly, the multistage shear flow device 1100 previously described with reference to FIGS. 11 to 14 may be also be utilized as a single stage compressor and turbine with the first stage 1102, for example, operating as a compressor, and the second stage 1140 operating as a turbine that powers the compressor.

In another example, the two stage shear flow device 1500 may be utilized as a two stage pump or compressor. In this example, the collector outlet (not shown) of the first collector plenum 1524 is connected to the second axial port 1522. The motor 1514 rotates the first shaft portion 1512, causing the first and second rotors 1508, 1510 to rotate. A fluid enters the first axial port 1516, passes through the first rotor 1508, and is collected at the first collector plenum cavity 1524. The fluid from the first collector plenum cavity 1524 then enters the second rotor cavity through the second axial port 1522 and is further compressed by the second rotor 1510 and collected in the second collector plenum cavity 1532.

In another example, the two stage flow device 1500 may be utilized as a two stage turbine. In this example, the motor 1514 may be replaced with a generator, and the first axial port 1516 is connected to the inlet (not shown) of the second nozzle plenum cavity 1538. Fluid enters the first nozzle plenum cavity 1530 and exits has a high pressure jet, which rotates the first rotor 1510 as described previously. The fluid passes through the first rotor 1508 and exits through the first axial port 1516. From the first axial port 1516, the fluid enters the second nozzle plenum cavity 1538 and exits as a high pressure jet causing rotation of the second rotor 1510. The fluid passes through the second rotor 1510 and exits through the second axial port.

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

The invention claimed is:

1. A shear flow turbomachinery device comprising:

a housing having housing walls defining a cavity;

a shaft extending into the cavity though a shaft opening in the housing wall at an end of the cavity;

a rotor coupled to the shaft within the cavity, the rotor having a plurality of disks extending radially outward from a central axis of the rotor, the disks having a spaced arrangement forming a gap between adjacent disks; and a first shroud for shrouding the rotor, the shroud including:

a first pair of end disks coupled to opposing ends of the rotor;

a first screen extending between outer edges of the first pair of end disks, the first screen extending around the rotor between the rotor and the housing walls;

wherein the first shroud is freely rotatable independent of rotation of the rotor to reduce drag on the disks due to the housing walls when the cavity is filled with fluid and the shaft and plurality of disks are rotated.

2. The shear flow turbomachinery device of claim 1, wherein the housing walls define a conical-shaped cavity, and the plurality of disks are arranged such that diameters of the disks increase with increased distance from a first end of rotor such that the rotor has a conical shape that generally matches the conical shape of the conical-shaped cavity.

3. The shear flow turbomachinery device of claim 1, comprising a second shroud comprising a second screen extending around the first shroud between the first screen and the housing walls.

4. The shear flow turbomachinery device of claim 3, wherein the second shroud is a fixed shroud.

5. The shear flow turbomachinery device of claim 3, wherein the second shroud comprises a second plurality of end disks coupled to opposing ends of the rotor between the housing walls and a respective one of the first pair of end disks, and wherein:

the second screen extends between the outer edges of the second pair of end disks; and the second shroud is freely rotatable independent of the rotation of the rotor and the rotation of the first shroud when the cavity is filled with fluid and the shaft and plurality of disks are rotated.

6. The shear flow turbomachinery device of claim 5, comprising a third shroud comprising a third screen extending around the second shroud between the second screen and the housing walls, wherein the third shroud is a fixed shroud.

7. The shear flow turbomachinery device of claim 5, further comprising:

a first pair of bearings, each one of the first pair of bearings located between a respective one of the second end disks of the second shroud and the housing wall; and a second pair of bearings, each one of the second pair of bearings located between a respective one of the second end disks of the second shroud and a respective one of the first end disks of the first shroud.

8. The shear flow turbomachinery device of claim 7, wherein each of the first pair of bearings sits within a respective first cavity formed by corresponding notches in the second end disks and the housing wall, and each of the second pair of bearings sits within a respective second cavity formed by corresponding notches in the second end disks and the first end disks.

9. The shear flow turbomachinery device of claim 7, wherein the first and second pairs of bearings are electrodynamic homopolar levitating bearings.

10. The shear flow turbomachinery device of claim 7, further comprising a third pair of bearings, each one of the third pair of bearings located between a respective one of the first end disks and the rotor such that the third pair of bearings supports the rotor and the shaft within the housing.

11. The shear flow turbomachinery device of claim 1, wherein a surface of each of the plurality of disks of the rotor are roughened to increase drag between disks and a fluid in the gap between adjacent disks.

12. The shear flow turbomachinery device of claim 11, wherein the surface of each of the plurality of disks is roughened by a plurality of protrusions extending from the surface of each disk into the gap with an adjacent disk.

13. The shear flow turbomachinery device of claim 12, wherein at least a portion of the plurality of protrusions extending from the surface of each disk bridge the gap with an adjacent disk.

14. The shear flow turbomachinery device of claim 12, wherein the plurality of protrusions extend from the surface of each disk with varying heights.

15. The shear flow turbomachinery device of claim 12, wherein the plurality of protrusions are formed by stamping the plurality of disks prior to installation in the rotor to form a protrusion on a first surface of the disk and a corresponding indentation on a second surface of the disk.

16. The shear flow turbomachinery device of claim 15, wherein protrusions of a first disk of the rotor are not aligned with the indentations of a second, adjacent disk of the rotor.

17. The shear flow turbomachinery device of claim 1, wherein the screen is a porous membrane formed of one of a wire mesh and a fabric sheet.

18. The shear flow turbomachinery device of claim 1, further comprising one or more nozzles for applying a fluid jet from a nozzle outlet tangentially to the plurality of disks to cause rotation of the rotor, each nozzle having a nozzle inlet in fluid communication with the nozzle outlet via a plenum chamber.

19. The shear flow turbomachinery device of claim 1, wherein the housing includes a fluid outlet having a flow rate regulator for regulating the pressure within the cavity.

* * * * *